US012589325B2

(12) United States Patent
Percy-Hughes et al.

(10) Patent No.: US 12,589,325 B2
(45) Date of Patent: Mar. 31, 2026

(54) TOY SYSTEM

(71) Applicant: MOOSE CREATIVE MANAGEMENT PTY LIMITED, Cheltenham (AU)

(72) Inventors: Edward Percy-Hughes, Trevosker (GB); James Austin-Smith, Perranwell Station (GB); Ross Monks, St Columb Major (GB)

(73) Assignee: MOOSE CREATIVE MANAGEMENT PTY LIMITED, Cheltenham (AU)

( * ) Notice: Subject to any disclaimer, the term of this patent is extended or adjusted under 35 U.S.C. 154(b) by 174 days.

(21) Appl. No.: 18/527,972

(22) Filed: Dec. 4, 2023

(65) Prior Publication Data

US 2024/0189731 A1 Jun. 13, 2024

Related U.S. Application Data

(60) Provisional application No. 63/386,849, filed on Dec. 9, 2022.

(51) Int. Cl.

| | |
|---|---|
| ***A63H 33/30*** | (2006.01) |
| ***A63J 21/00*** | (2006.01) |
| *A63H 3/02* | (2006.01) |

(52) U.S. Cl.
CPC ..... *A63H 33/3055* (2013.01); *A63J 21/00* (2013.01); *A63H 3/02* (2013.01)

(58) Field of Classification Search
CPC .... A63H 33/30; A63H 33/3055; A63H 3/005; A63H 3/02; A63J 21/00
(Continued)

(56) References Cited

U.S. PATENT DOCUMENTS 1,565,209 A * 12/1925 Schwarzenhauer ..... F24C 7/00 219/404
1,587,305 A * 6/1926 Hartman ..... A63H 33/3055 446/481

(Continued)

FOREIGN PATENT DOCUMENTS

| | | | |
|---|---|---|---|
| GB | 1414104 | A | 11/1975 |
| GB | 2349835 | A | 11/2000 |
| JP | 2005/034440 | A | 2/2005 |

OTHER PUBLICATIONS

PCT International Search Report and Written Opinion for PCT/US2023/082299 dated Mar. 20, 2024.

*Primary Examiner* — Alexander R Niconovich
(74) *Attorney, Agent, or Firm* — KNOBBE, MARTENS, OLSON & BEAR, LLP

(57) ABSTRACT

An interactive toy system includes a miniature oven having an oven door, a dial knob, and an internal space. An upper shelf is disposed at an upper position inside the internal space, and a lower shelf is disposed at a lower position that is below the upper position inside the internal space. The upper shelf is capable of moving down to the lower position, which causes the lower shelf to move down to a bottom position. A plush doll is placed on the upper shelf when it is at the upper position. During a play, a dough is placed inside the oven on the lower shelf, and the dial knob is turned to start a "baking" process. The knob turning causes the upper shelf carrying the plush doll to drop down to the lower position and the lower shelf carrying the dough to drop down to the bottom position.

22 Claims, 45 Drawing Sheets

(58) Field of Classification Search
USPC ..... 446/73, 481, 487
See application file for complete search history.

(56) References Cited

U.S. PATENT DOCUMENTS 2,997,807 A * 8/1961 Woron ..... A63H 33/30 446/479
3,058,259 A * 10/1962 Kripak ..... A63H 33/30 446/481
3,133,376 A * 5/1964 Orenstein ..... A63H 33/30 446/481
3,368,063 A * 2/1968 Kuhn ..... A63H 33/3055 126/19 R
3,548,146 A * 12/1970 Hoyland ..... A63H 33/3055 392/416
3,765,120 A * 10/1973 Waak ..... A63H 33/30 446/481
3,808,730 A * 5/1974 Cooper ..... A63H 33/3055 446/481
4,188,748 A * 2/1980 Rich ..... A63H 17/44 446/471
4,249,067 A * 2/1981 Cummings ..... A63H 33/3055 219/400
4,515,359 A * 5/1985 Mariol ..... A63H 3/52 446/481
4,563,573 A * 1/1986 Hartelius ..... A63H 33/3055 126/192
4,604,076 A * 8/1986 St. Pierre ..... A63H 33/3055 446/481
4,772,243 A * 9/1988 Zeiss ..... A63H 33/3055 446/481
4,781,646 A * 11/1988 Dibley ..... A63H 33/3055 446/481
5,306,192 A * 4/1994 Caveza ..... A63H 33/3055 446/481
5,422,458 A * 6/1995 Simmel ..... F24C 7/00 446/481
5,451,745 A * 9/1995 Goldberg ..... A63H 33/3055 219/386
5,522,755 A * 6/1996 Farrell ..... A63H 23/16 446/268
5,716,253 A * 2/1998 Aoki ..... A63H 33/22 446/481
6,033,286 A * 3/2000 Langlinais ..... A63H 33/3055 446/481
7,481,153 B2 * 1/2009 Barnes ..... A47J 37/0821 219/521
8,426,775 B2 * 4/2013 Frank ..... A63H 33/3055 219/400
8,568,193 B1 * 10/2013 Evans ..... A63H 33/3055 446/168
8,568,194 B2 * 10/2013 Fein ..... A63H 33/3055 446/151
11,179,651 B2 * 11/2021 Kamiyama ..... A63H 33/3055
11,786,834 B2 * 10/2023 Del Giudice ..... A63H 3/006 446/73
12,263,417 B2 * 4/2025 Kamiyama ..... A63H 33/3055
2003/0027482 A1 * 2/2003 Dumigan ..... A63H 33/3055 446/74
2008/0096463 A1 * 4/2008 Wojtkiewicz ..... A63H 33/3055 446/481
2017/0023257 A1 * 1/2017 Arnold, IV ..... A21B 5/00
2017/0173489 A1 * 6/2017 Akavia ..... A63H 33/3055

* cited by examiner

TOY SYSTEM

CROSS-REFERENCE TO RELATED APPLICATION

This application claims benefit under 35 U.S.C. 119(e) to U.S. Provisional Patent App. No. 63/386,849, filed Dec. 9, 2022, the entire disclosure of which is hereby incorporated by reference herein in its entirety. Any and all priority claims identified in the Application Data Sheet, or any corrections thereto, are hereby incorporated by reference under 37 CFR 1.57.

BACKGROUND

Field

A toy system is described. More specifically, embodiments of the toy system provide an interactive experience for a user to reveal a hidden toy.

SUMMARY

The present disclosure is directed to a toy system resembling a miniature oven. An aspect of the disclosure is a toy system having an internal space for housing a toy. The toy system can include a housing having an opening, a door disposed relative to the opening so as to close and open the housing, and an upper shelf movably disposed in the internal space and capable of moving from an upper position to a lower position, the upper shelf being configured to support the toy. When the upper shelf is in the upper position the upper shelf is located above the door and the toy is not visible through the opening, and wherein when the upper shelf is at the lower position in the internal space the toy is visible through the opening.

A variation on the above aspect further comprises a lower shelf movably disposed in the internal space of the housing and capable of moving from the lower position to a bottom position, wherein when the lower shelf is at the lower position a space above the lower shelf is visible through the opening, and wherein when the lower shelf is at the bottom position the space is not visible through the opening.

A variation on the above aspect further comprises a knob coupled to the housing, wherein operating the knob causes the upper shelf to move from the upper position to the lower position.

A variation on the above aspect further comprises a knob coupled to the housing, wherein operating the knob causes the upper shelf to move from the upper position to the lower position and the lower shelf to move from the lower position to the bottom position.

A variation on the above aspect is wherein the upper shelf is supported when in the upper position by a latch.

A variation on the above aspect is wherein operating the knob causes a latch to disengage from the upper shelf.

A variation on the above aspect is wherein opening the door prevents a user from rotating the knob.

A variation on the above aspect is wherein when the door is closed and while the user rotates the knob, the door cannot be opened.

A variation on the above aspect is wherein operating the knob initiates an oven baking process.

A variation on the above aspect further comprises the toy, wherein the toy comprises a scent bag.

A variation on the above aspect further comprises the toy, wherein the toy comprises a heater.

A variation on the above aspect is wherein the toy further comprises a module, the module being electrically coupled to the heater.

An aspect of the disclosure is a toy system that includes a chamber having a wall forming an internal space configured to hold a toy and a door disposed as to close and open the chamber, a shelf movably disposed in the internal space and capable of moving from an upper position to a lower position, wherein when the shelf is at the upper position the shelf and a portion of the internal space above the shelf is not visible through the door, and wherein when the shelf is at the lower position the portion of the internal space above the shelf is visible through the door.

A variation on the above aspect further comprises the toy, wherein the toy comprises a scent bag.

A variation on the above aspect further comprises the toy, wherein the toy comprises a heater.

A variation on the above aspect is wherein the toy further comprises a module, the module being electrically coupled to the heater.

An aspect of the disclosure is a method of playing with a toy system, the toy system comprising a toy disposed on an upper shelf movably located at an upper position in an internal space of the toy system, the toy being hidden from view. The method including turning a knob on the toy system to cause the upper shelf supporting the toy to move to a lower position and opening a door of the toy system to reveal the toy.

A variation on the above aspect further includes placing a dough on a lower shelf in the internal space, the lower shelf being movably between a lower position and a bottom position and turning the knob also causes the lower shelf carrying the dough to move to the bottom position.

A variation on the above aspect is wherein the toy is a plush doll.

A variation on the above aspect further comprises emitting a scent.

A variation on the above aspect further comprises emitting heat.

BRIEF DESCRIPTION OF THE DRAWINGS

Various embodiments are depicted in the accompanying drawings for illustrative purposes and should in no way be interpreted as limiting the scope of the embodiments. In addition, various features of different disclosed embodiments can be combined to form additional embodiments, which are part of this disclosure.

DETAILED DESCRIPTION

The present description will be directed in particular to elements forming part of, or cooperating more directly with, apparatus and methods in accordance with the disclosure. It is to be understood that elements not specifically shown or described may take various forms well known to those skilled in the art.

Embodiments of the toy system disclosed herein, provide a user (or player) or a group of users an experience of revealing a toy, such as a doll. In certain embodiments, the doll is a plush doll. In certain embodiments, the toy system includes a heater to warm or heat the doll. In certain embodiments, the toy system creates a smell or scent reminiscent of oven baked food. For example, in certain embodiments, the toy system resembles a miniature oven, and when it is unpackaged, the doll is held in an internal space within the miniature oven that is not visible by a user or player. This aspect increases the user's curiosity and anticipation. In some embodiments, the user completes one or more actions to play with the toy system, including, for example, making an animal shaped dough, placing the dough animal into the oven, and "baking" it for a period of time. When the oven signals it is ready, the user opens the oven door, and an animal shaped plush doll has now mysteriously replaced the dough animal. The actions make the unboxing and toy revealing process enjoyable and exciting.

Figure 1:
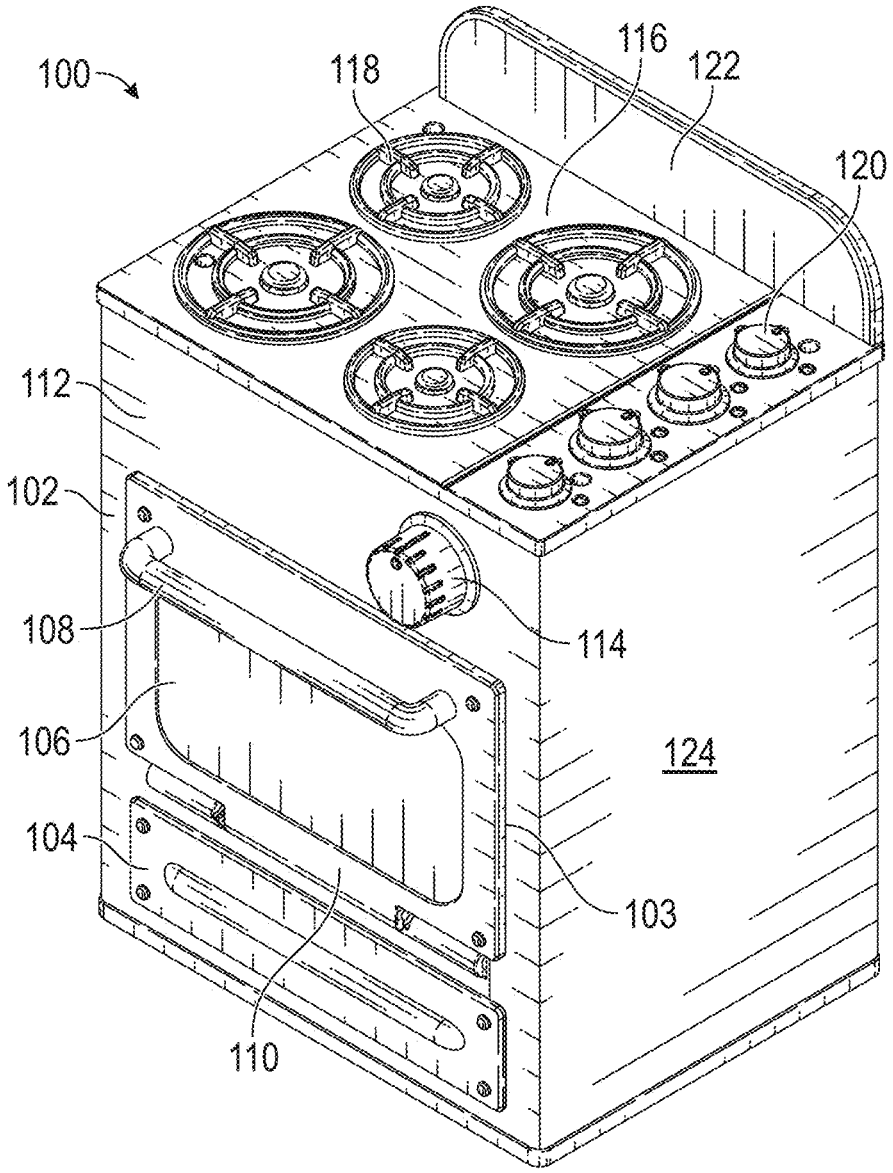
FIG. 1 is a perspective view of a toy system according to an embodiment of the disclosure.

Referring to the figures, FIG. 1 is a perspective view of a toy system 100 according to an embodiment of the disclosure. In certain embodiments, the toy system 100 is a generally box shaped chamber with walls forming an enclosed internal space. Of course the toy system 100 is not limited to the illustrated shape and can have any other shape (e.g., rectangular, round, triangular, etc.).

As shown in FIG. 1, the toy system 100 resembles a miniature oven. Of course the toy system 100 is not limited to the illustrated appliance and can be configured to represent different appliances or devices, e.g., a dishwasher (e.g., dirty dishes appear clean), microwave oven (e.g., food appears cooked), toaster oven (e.g., food appears cooked), washing machine (e.g., dirty clothes appear clean), clothes dryer (e.g., wet clothes appear dry), mail box (e.g., mail appears/disappears), etc. Accordingly, the disclosure is not limited to the illustrated embodiments.

In certain embodiments, the miniature oven has a front wall 102 with a lower panel 104 attached on a lower portion of the front wall 104. In certain embodiments, the lower panel 104 resembles an openable oven feature such as drawer, but is in fact for cosmetic purposes and not functional.

The front wall 102 comprises an opening 103. In certain embodiments, the opening 103 is disposed in the middle of the front wall 102 and releasably covered by an oven door 106, as shown in FIG. 1. In certain embodiments, the oven door 106 is pivotally coupled to a mechanism 110. In certain embodiments, the mechanism 110 is attached to or formed on the front wall 102 at a lower edge of the opening 103 and a lower edge of the oven door 106. As such, the oven door 106 can be opened by pulling a door handle 108 attached to an upper edge of the oven door 106. When the oven door 106 is opened, part of the internal space inside the miniature oven toy system 100 is revealed through the opening 103 in the front wall 102. In certain embodiments, the front wall 102 comprises an upper panel 112 above the oven door 106. In certain embodiments, a dial knob 114 is coupled to the upper panel 112 and connected to an internal mechanism to operate the miniature oven.

In certain embodiments, on top of the toy system 100 is an oven top 116 having range features (e.g., grates, burners, etc.) 118 and knob features 120. These range features 118 and knob features 120 make the toy system 100 look more like a real miniature oven, but they are for cosmetic appearance and not functional. On the backside of the oven top 116 is a back guard 122. In FIG. 1 is also shown a right sidewall 124.

Figure 2:
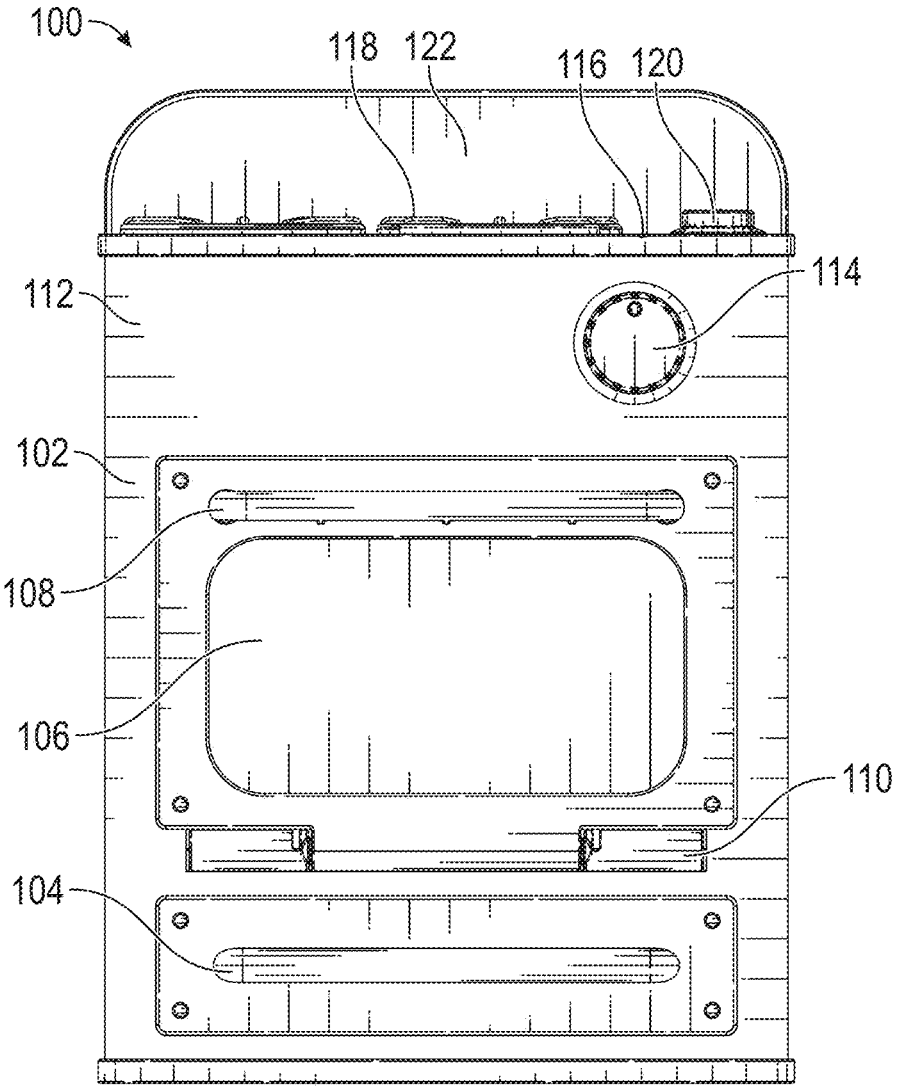
FIG. 2 is a front view of the toy system of FIG. 1.

Referring to FIG. 2, a front view of the toy system 100 is shown to illustrate the features in the front wall 102, at a different angle from the view of FIG. 1. In certain embodiments, the features include the lower panel 104 attached on the front wall 102, the oven door 106 having a door handle 108 attached thereon, and the dial knob 114 being coupled to the upper panel 112 of the front wall 102. In certain embodiments, the oven door 106 is pivotally attached to the front wall 102 via the mechanism 110. FIG. 2 also shows the oven top 116 having the range features (e.g., grates, burners, etc.) 118 and the knob features 120 thereon, and the back guard 122.

Figure 3:
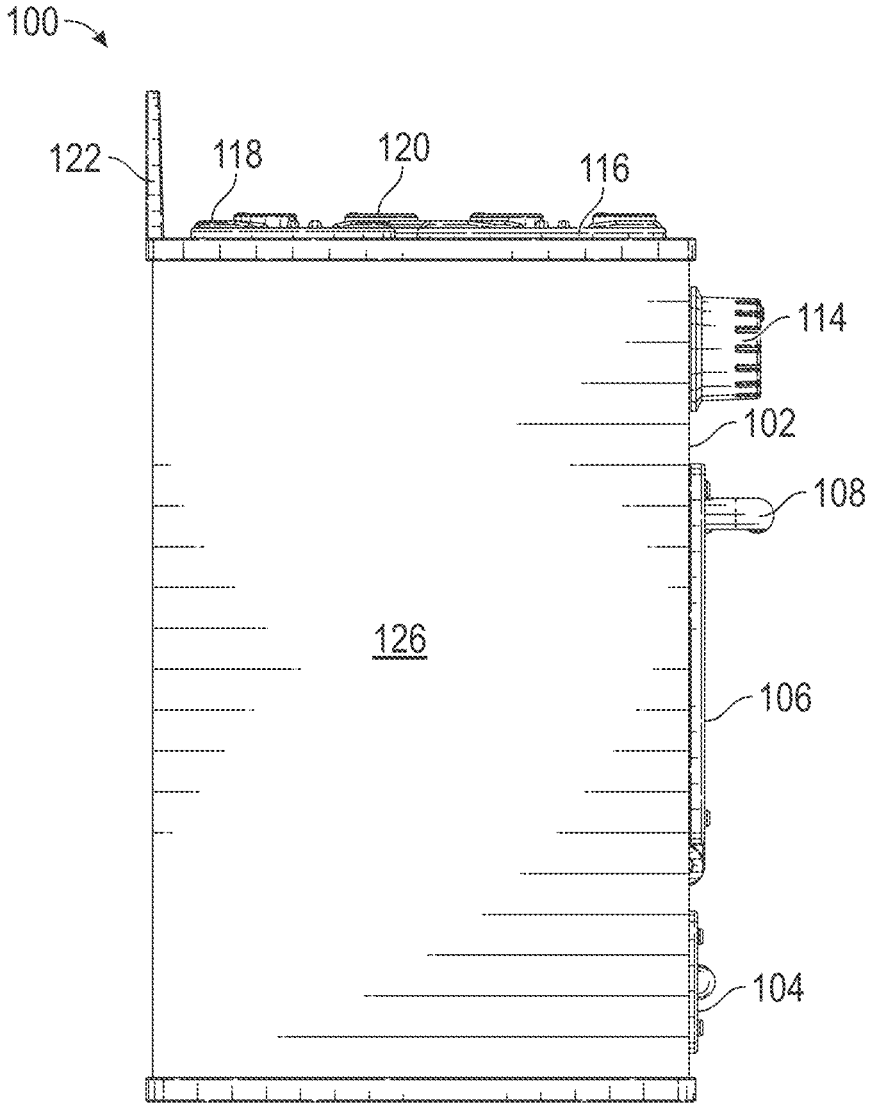
FIG. 3 is a left view of the toy system of FIG. 1.
Figure 4:
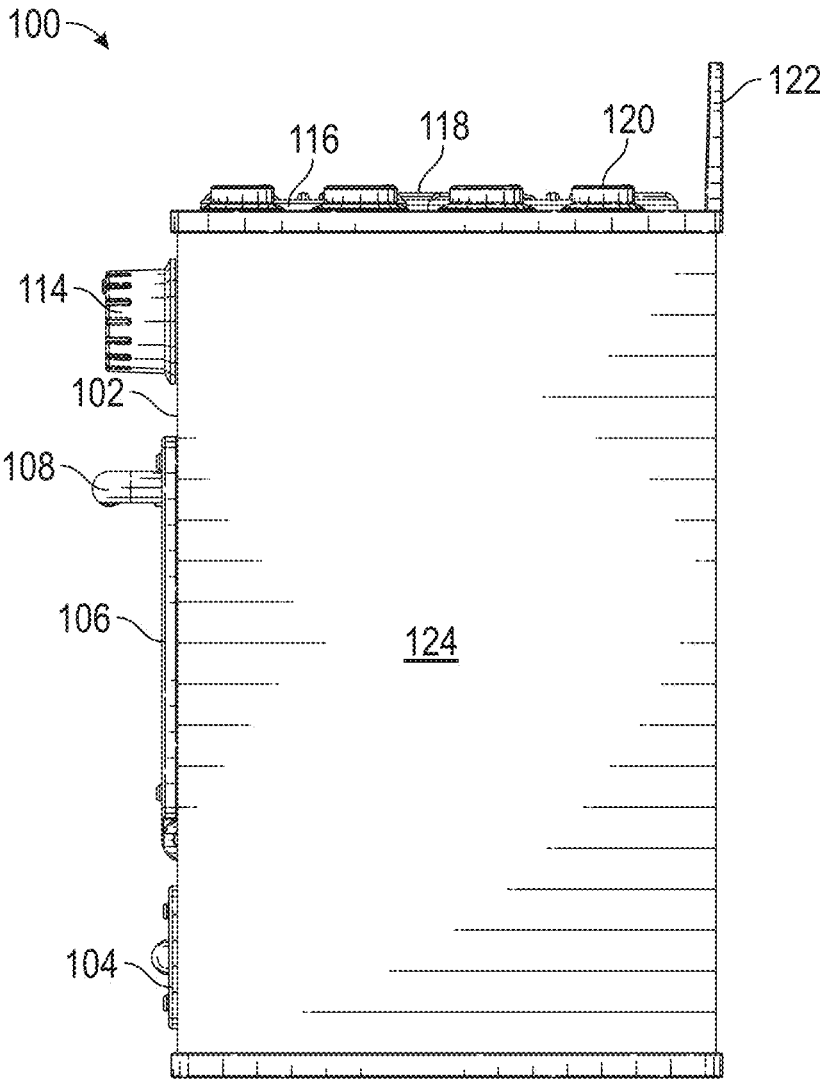
FIG. 4 is a right view of the toy system of FIG. 1.

The oven features located at the front wall 102 and the oven top 116 are also shown in FIG. 3 which is a left view of the toy system 100. FIG. 4 is a right view of the toy system 100. Also shown in FIG. 3 is a left sidewall 126, and in FIG. 4 is shown the right sidewall 124.

Figure 5:
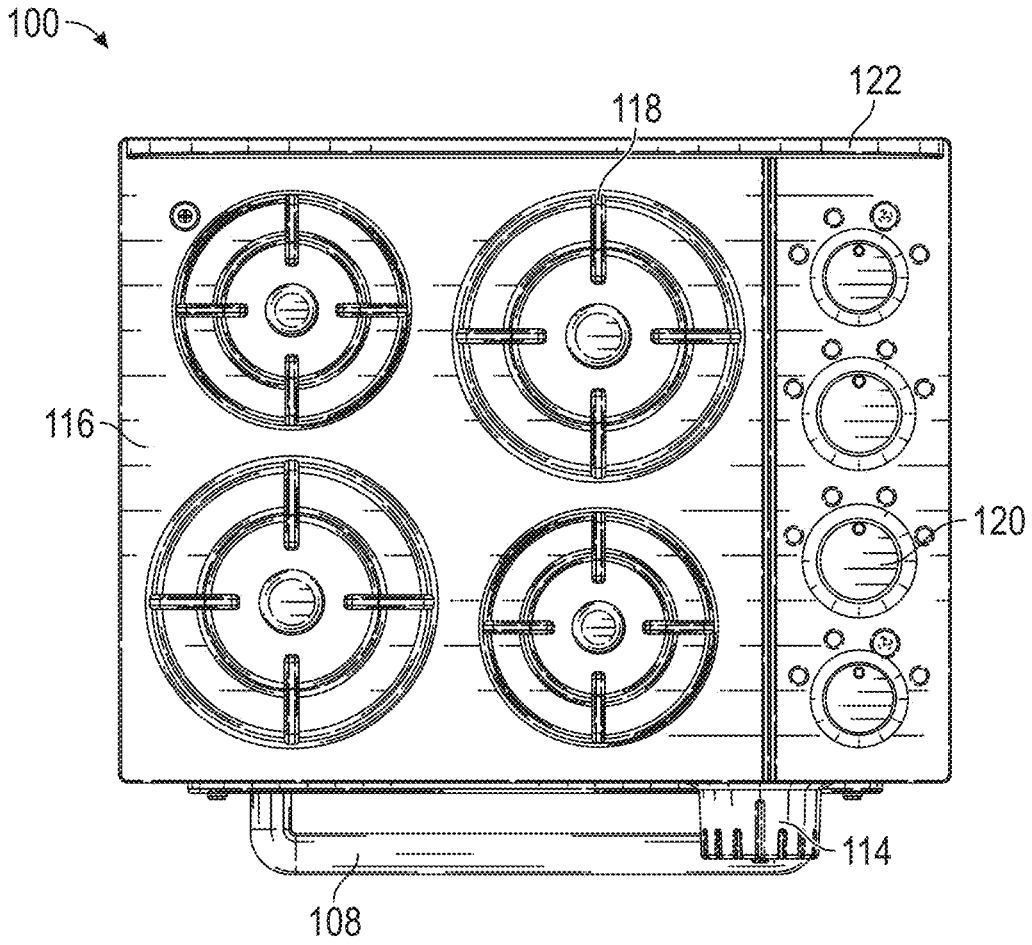
FIG. 5 is a top view of the toy system of FIG. 1.

FIG. 5 is a top view of the toy system 100. The features on the oven top 116, including the range features (e.g., grates, burners, etc.) 118, the knob features 120 and the back guard 122, are clearly shown. Though non-functional, the range features 118 and the knob features 120 resemble real oven features.

Figure 6:
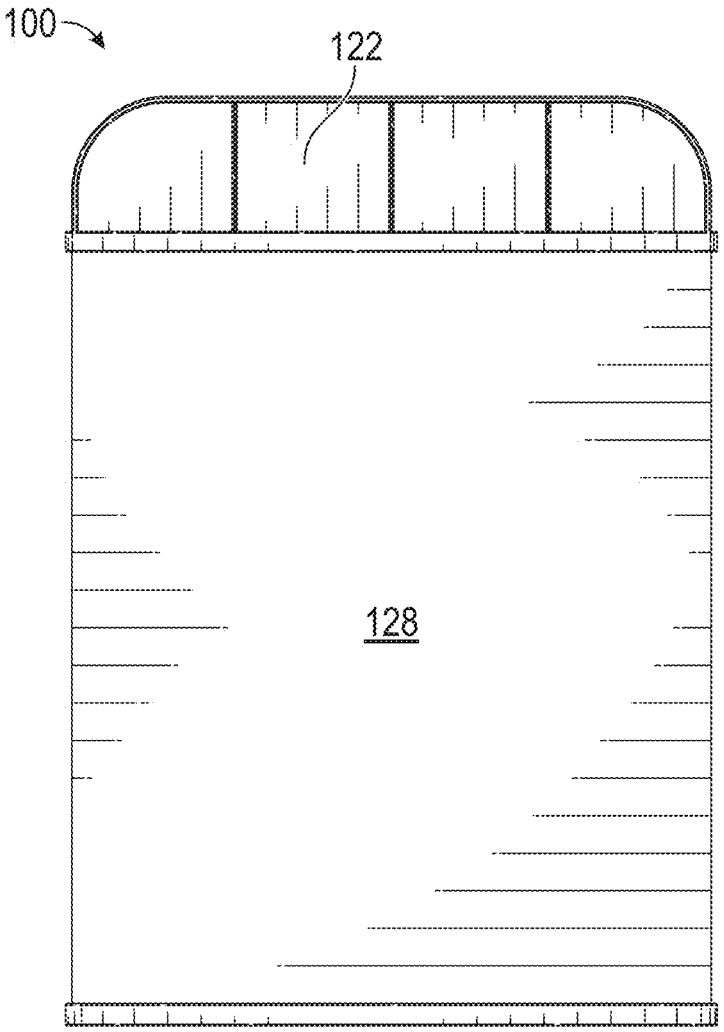
FIG. 6 is a back view of the toy system of FIG. 1.
Figure 7:
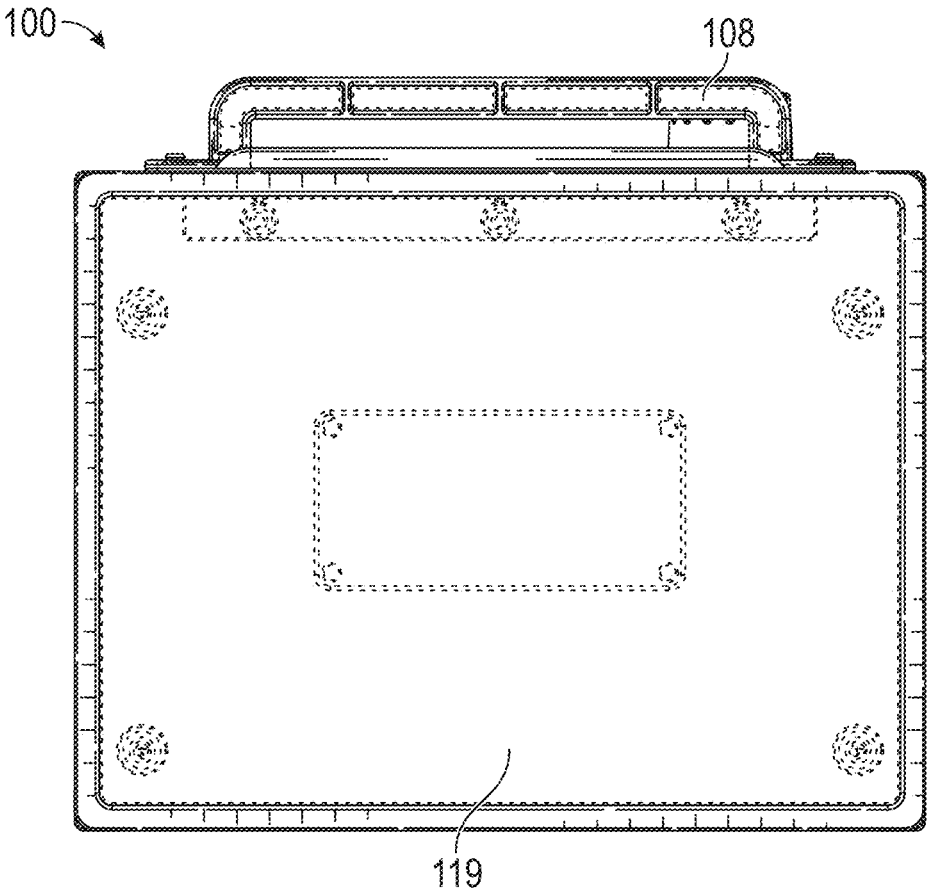
FIG. 7 is a bottom view of the toy system of FIG. 1.

FIG. 6 is a back view of the toy system 100, showing a back wall 128, and the back guard located above the backwall 128. FIG. 7 is a bottom view of the toy system 100 having a bottom wall 119. Disposed inside the space formed by the walls at the front, the back, the left, the right, and the bottom are internal structures.

Figure 8:
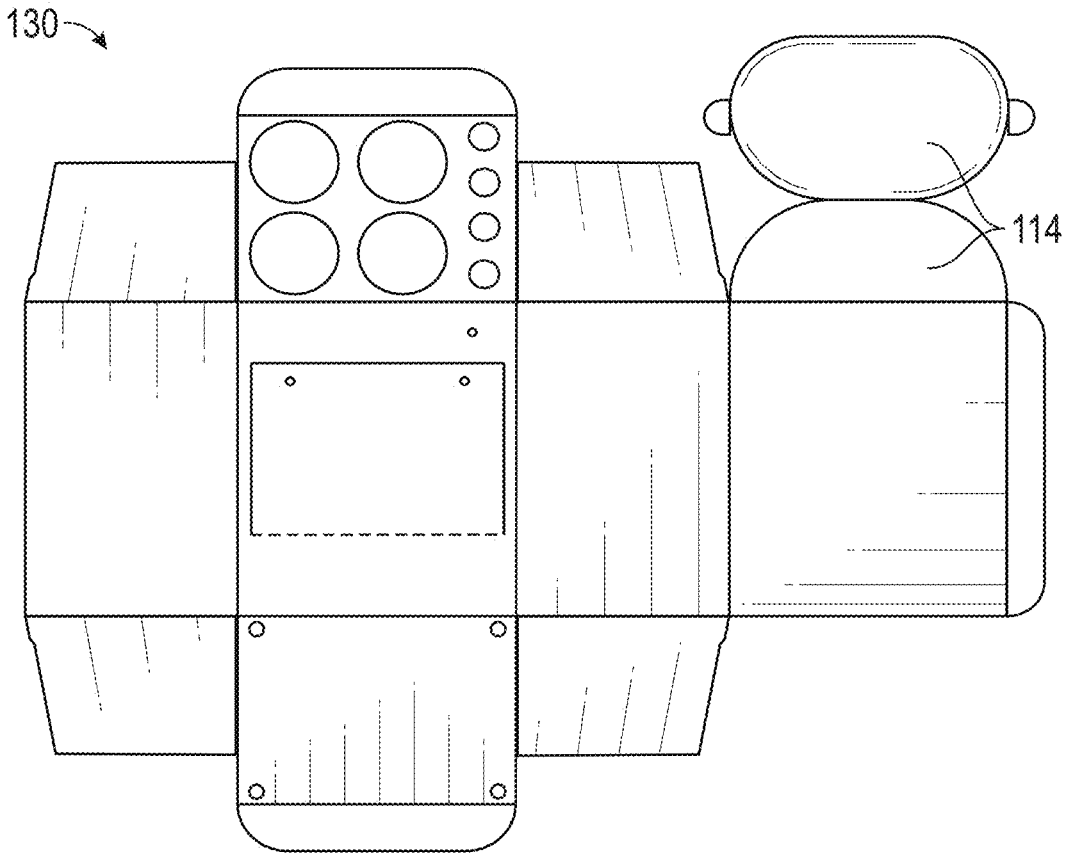
FIG. 8 is a plan view of a sheet of material that could be folded to form packaging for the toy system of FIG. 1.

FIG. 8 is a plan view of a sheet 130 of material that could be folded to form packaging for the toy system 100 of FIG. 1. The sheet 130 can be made of corrugated cardboard, sheet plastic material, sheet composite material, or sheet metal. In some embodiments when a softer material, such as corrugated cardboard or sheet plastic, is used, the whole sheet 130 can be cut in to a shape according to the drawing shown in FIG. 8. The edge lines between walls can then be creased or bent. Finally, the sheet 130 is folded along the edge lines to form the outer walls of the packaging for the toy system 100. Extensions or doublers 114 can be folded together.

Figure 9:
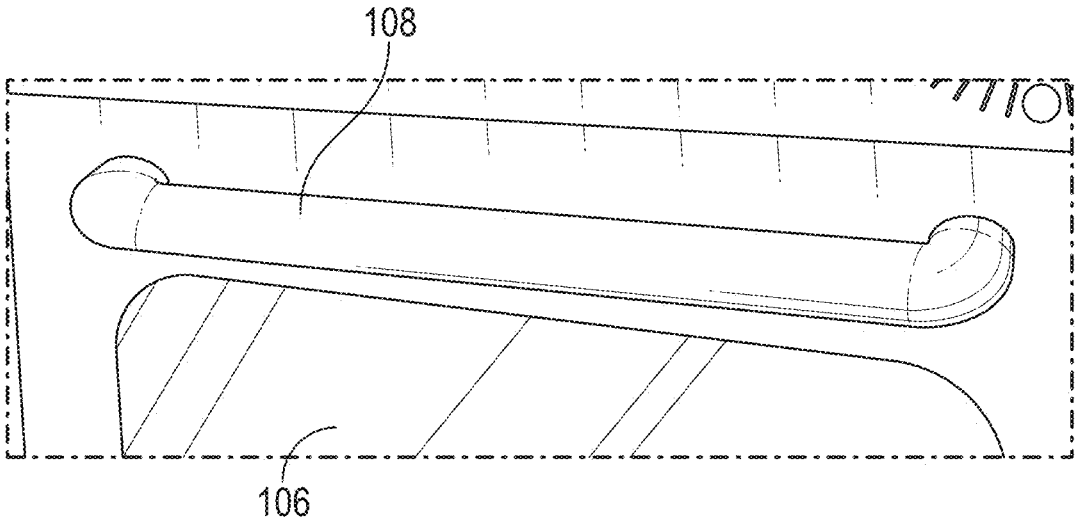
FIG. 9 is partial view of the toy system of FIG. 1 showing an oven door handle attached to an oven door of the toy system.

FIG. 9 is partial view of the toy system 100 of FIG. 1 showing an oven door handle 108 attached to the oven door 106. The center portion of the oven door 106 has the appearance of a window that allows the user to look into the space inside the miniature oven. But this window-like feature is for cosmetic appearance only and may be created either with graphics or by translucent material.

Figure 10:
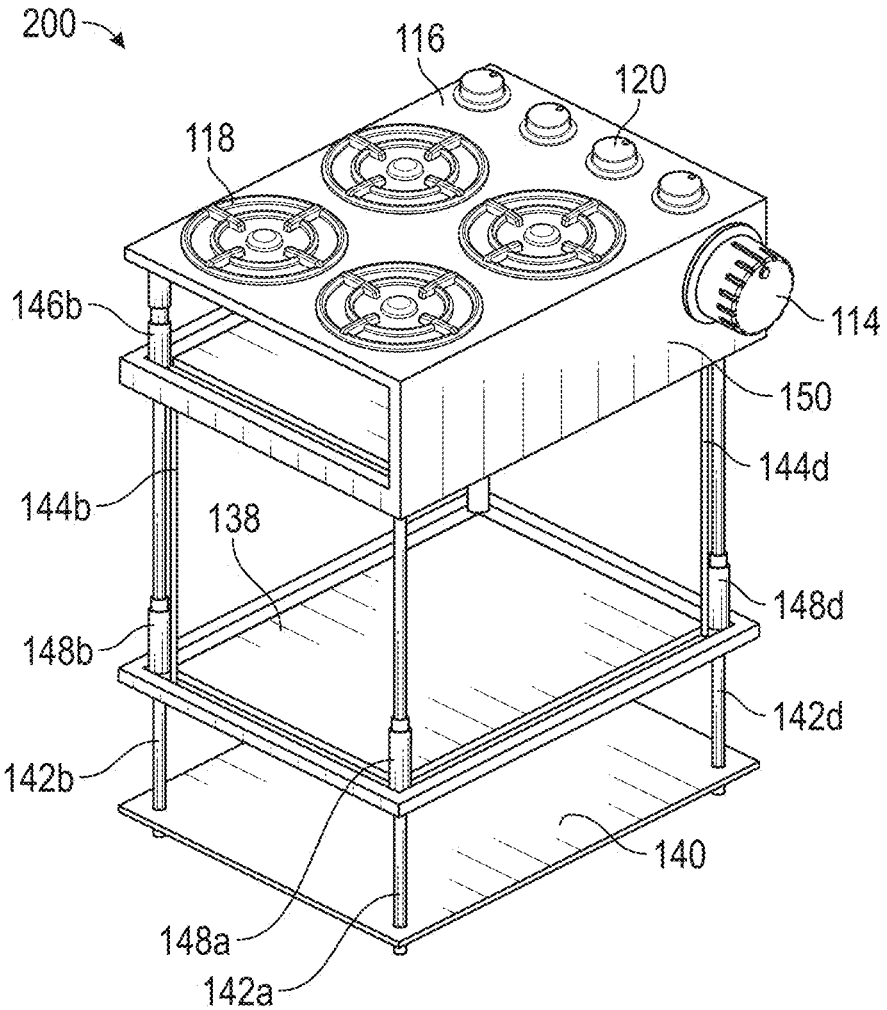
FIG. 10 is a perspective view of an embodiment of an internal structure of the toy system in FIG. 1.

Moving to FIG. 10, an embodiment of an internal structure 200 of the toy system 100 is depicted. The internal structure 100 is disposed in the internal space formed by the outer walls of the toy system 100, as shown in and discussed with FIG. 7. At the top is the oven top 116 shown in FIG. 1, including the non-functional range features 118 and the knob features 120. In front of oven top 116 is attached a control box 150 which has mechanisms therein to control the operation of the toy system 100. The control box 150 is operated by the dial knob 114 which is coupled with the mechanisms inside the control box 150.

In certain embodiments, below the oven top 116 there are a plurality of platforms. In the illustrated embodiment, there are three platforms or shelfs. In certain embodiments, at the top end is an shelf 136. In certain embodiments, in the middle is the shelf 138. In certain embodiments, at the bottom is the oven base 140. In certain embodiments, at each corner of the oven base 140 is attached one or more guiding posts 142*a*, 142*b*, 142*c* or 142*d*. In certain embodiments, the guiding posts 142*a*, 142*b*, 142*c* or 142*d* extend in a vertical direction. In certain embodiments, the guiding posts 142*a*-142*d* thread through respective bushings 148*a*-148*d* formed on respective corners of the shelf 138, and through respective bushings 146*a*-146*d* formed on respective corners of the shelf 136, and then are attached to respective corners of the oven top 116. In this way the oven top 116, the shelf 136, the shelf 138 and the oven base 140 are connected as the internal structure 200. Four guiding posts are used in the embodiment of the internal structure shown in FIG. 10. A different number of guiding posts 142*a*-142*d* can be employed and still fall within the disclosure.

Figure 11:
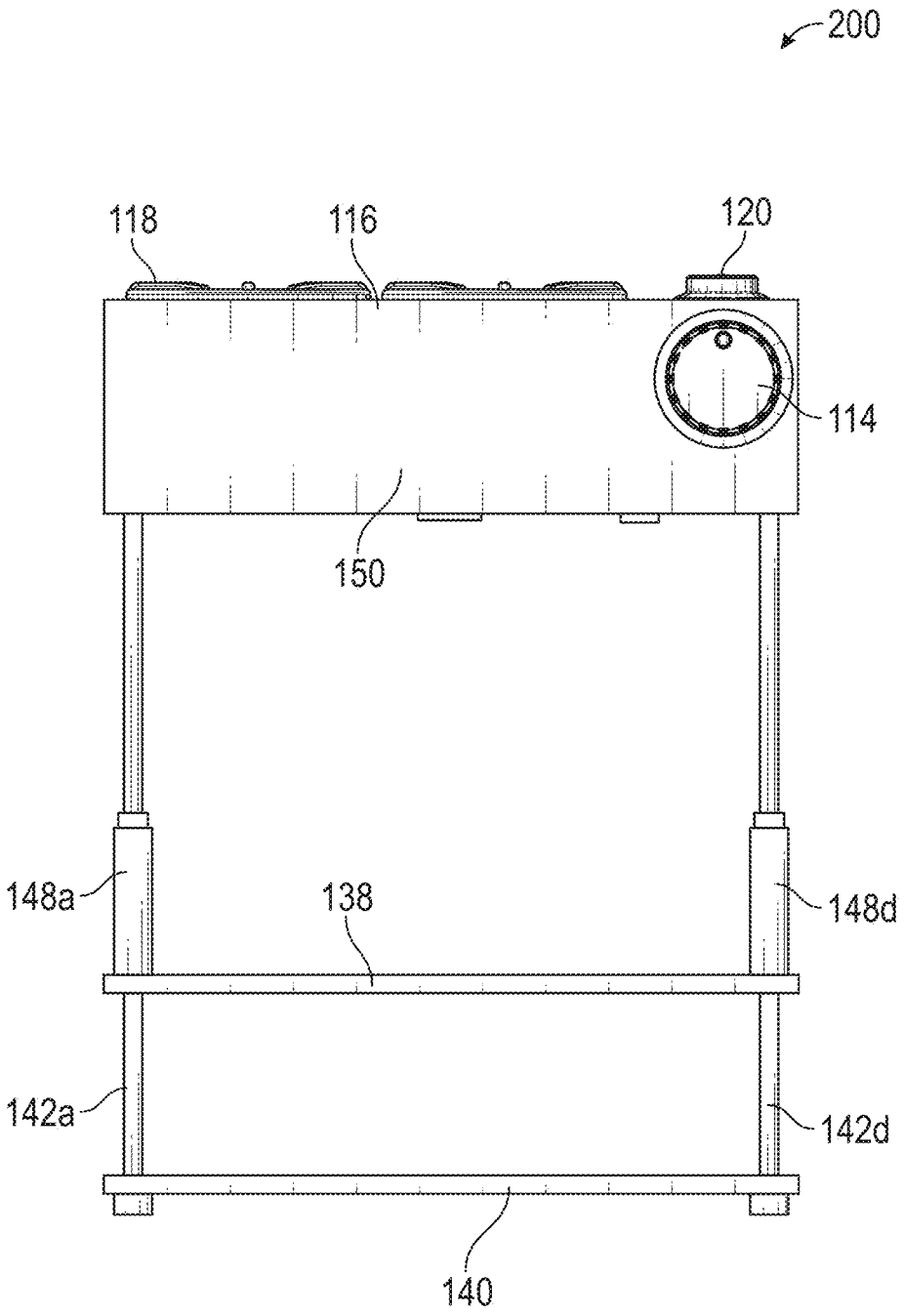
FIG. 11 is a front view of the internal structure shown in FIG. 10.
Figure 12:
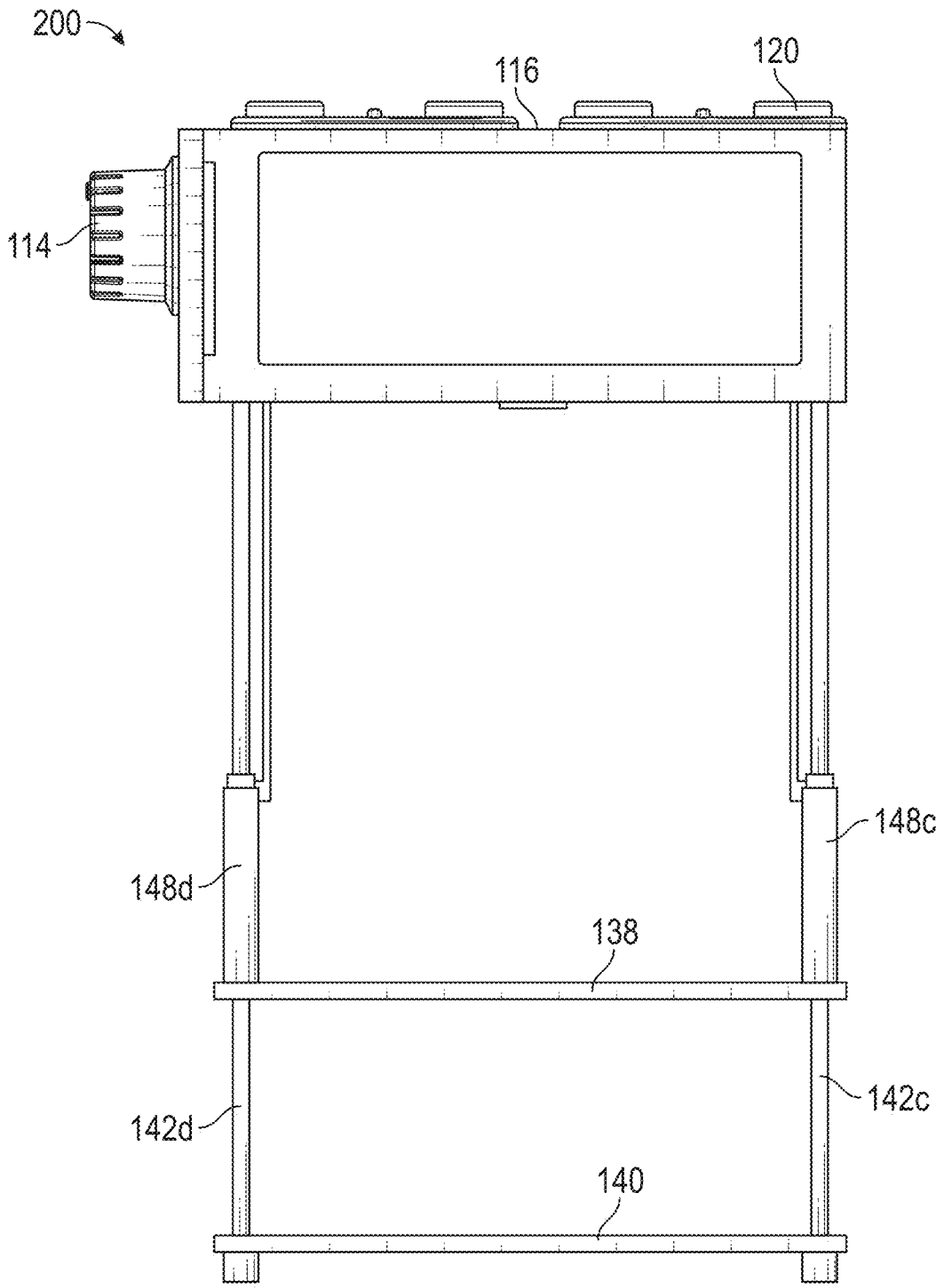
FIG. 12 is a side view of the internal structure shown in FIG. 10.

FIG. 11 is a front view of the internal structure 200 shown in FIG. 10. The connections between the oven top 116, the shelf 136, the shelf 138 and the oven base 140 by the plurality of guiding posts 142*a*-142*d* are further shown in FIG. 11. FIG. 12 is a side view of the internal structure shown 200 in FIG. 10. FIG. 11 and FIG. 12 also show the control box 150 and the dial knob 114.

Figure 13:
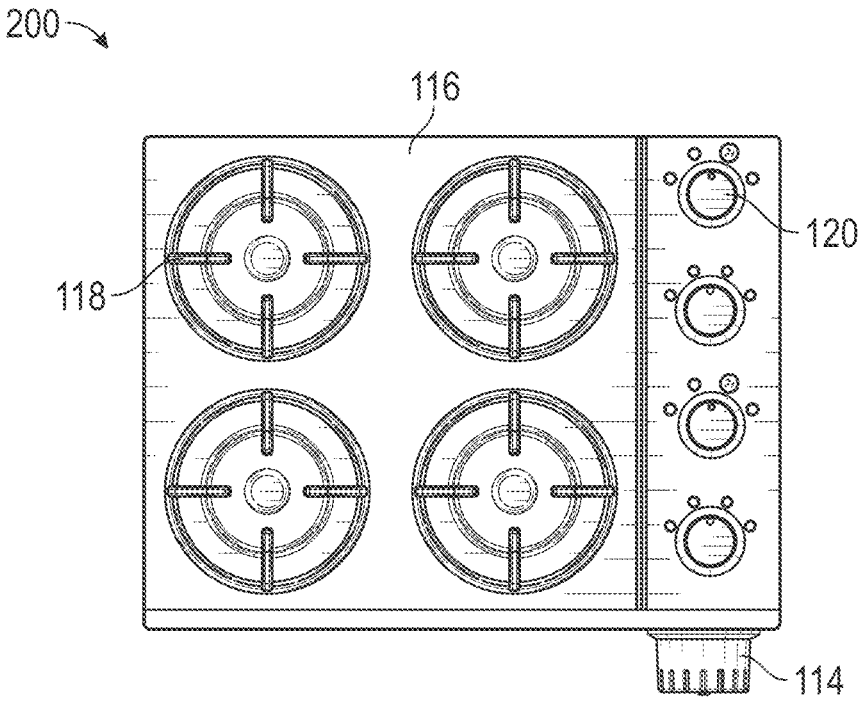
FIG. 13 is a top view of the internal structure shown in FIG. 10.
Figure 14A:
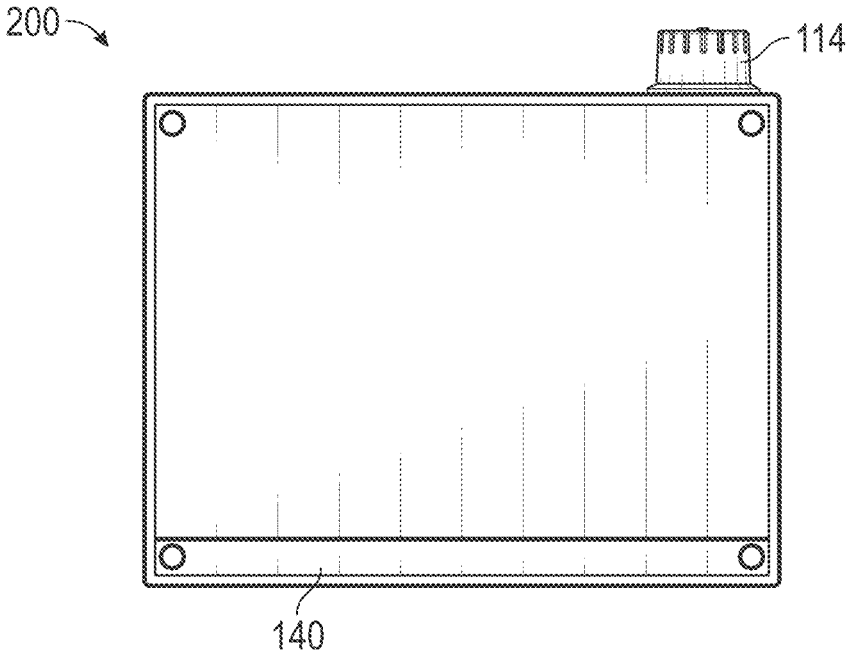
FIG. 14A is a bottom view of the internal structure shown in FIG. 10.
Figure 15:
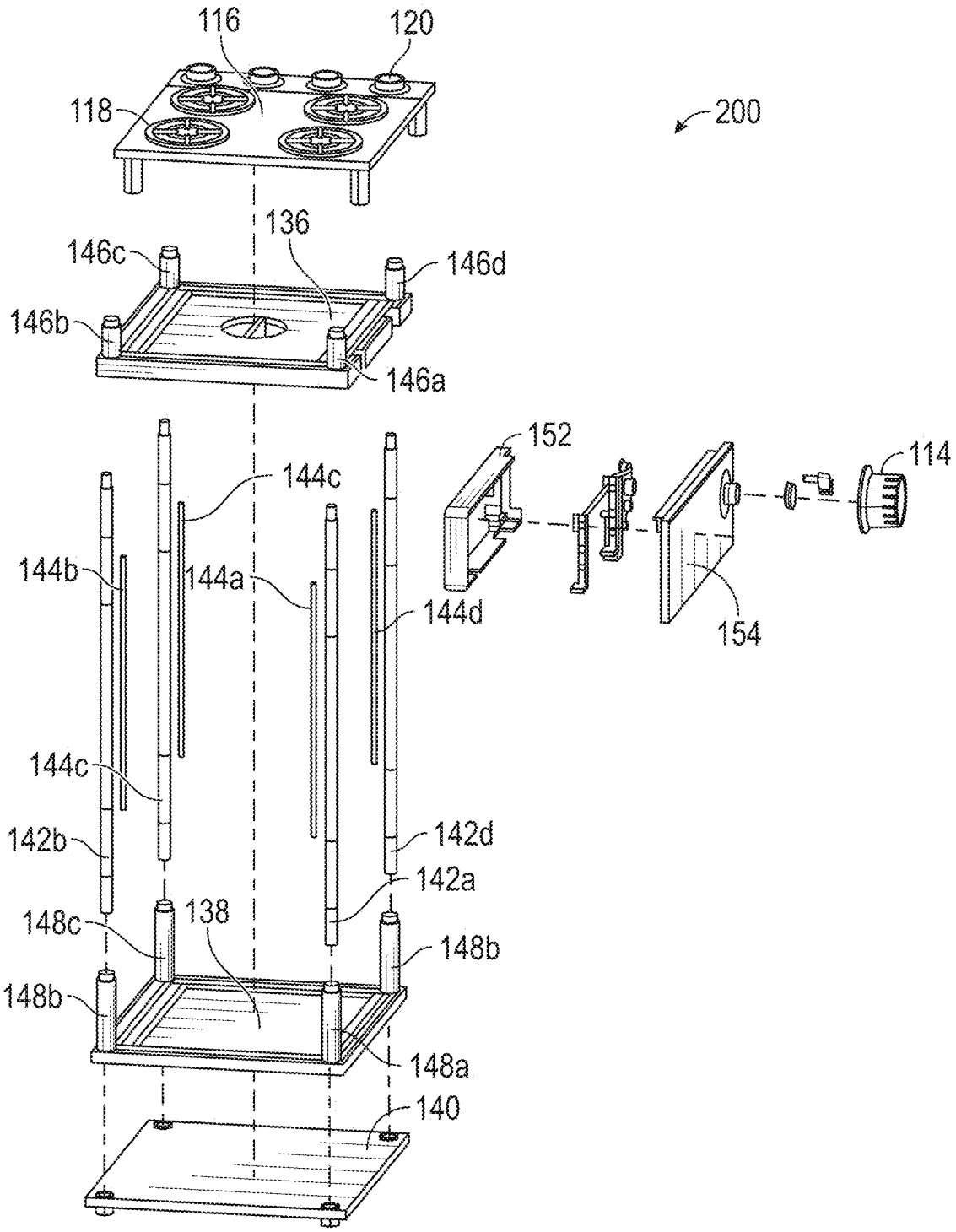
FIG. 15 is an exploded view of the internal structure shown in FIG. 10.

FIG. 13 is a top view of the internal structure 200 shown in FIG. 10. FIG. 14A is a bottom view of the internal structure 200 shown in FIG. 10. FIG. 15 is an exploded view of the internal structure 200 shown in FIG. 10. The internal structure 200 comprises the four guiding posts 142*a*-142*d*, respective bushings 148*a*-148*d* at the shelf 138, and respective bushings 146*a*-146*d* at the shelf 136. In certain embodiments, the internal structure 200 comprises four string cords 144*a*-144*d* juxtaposing their respective guiding posts 142*a*-142*d*. In certain embodiments, as shown in FIG. 10 and FIG. 12, each of the string cords 144*a*-144*d* are tied to the respective corner of the shelf 136 at one end and to the respective corner of the shelf 138 at the other end. As such, the distance between the shelf 136 and the shelf 138 is determined by the length of the string cords 144*a*-144*d*. In certain embodiments, the string cords 144*a*-144*d* are flexible and foldable. The functions of the string cords 144*a*-144*d* will be explained below.

Figure 14B:
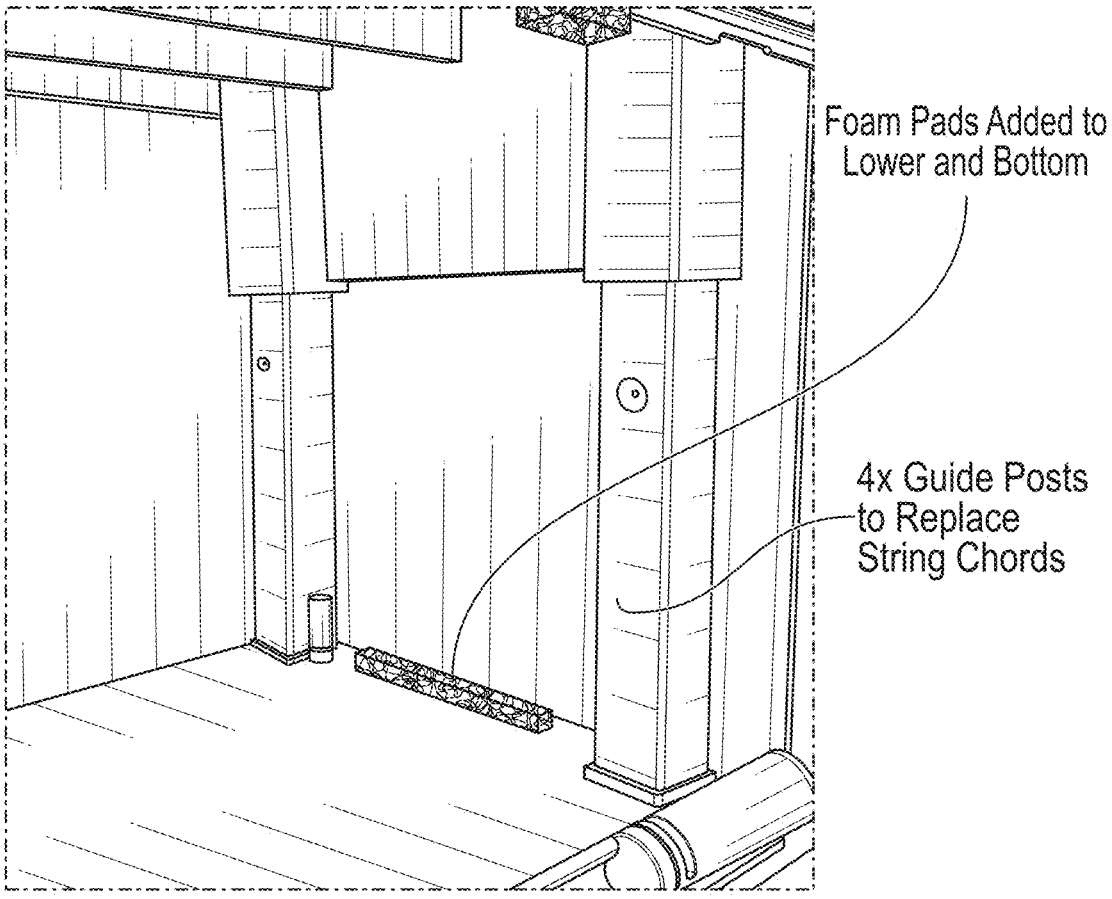
FIG. 14B is a view of an alternate internal structure that includes posts instead of string cords.

In certain embodiments as shown in FIG. 14B, the internal structure 200 comprises posts (e.g., molded posts) instead of string cords. In certain embodiments, the posts are configured to extend and/or contract (e.g., telescope) in length. For example, in certain embodiments, the posts are hollow tubular sections, which are slideably received within each other. In this way, the post can be extended and retracted to various lengths.

The internal structure 200 comprises the control box 150. In certain embodiments, the control box 150 comprises a back casing 152 and a front casing 155. The dial knob 114 can be located in front of the front casing 154.

In certain embodiments as illustrated in FIG. 14B, one or more foam pads are added to the lower and bottom platforms. The foam pad feature added to the lower and bottom platforms can advantageously dampen sound when dropped.

Figure 16:
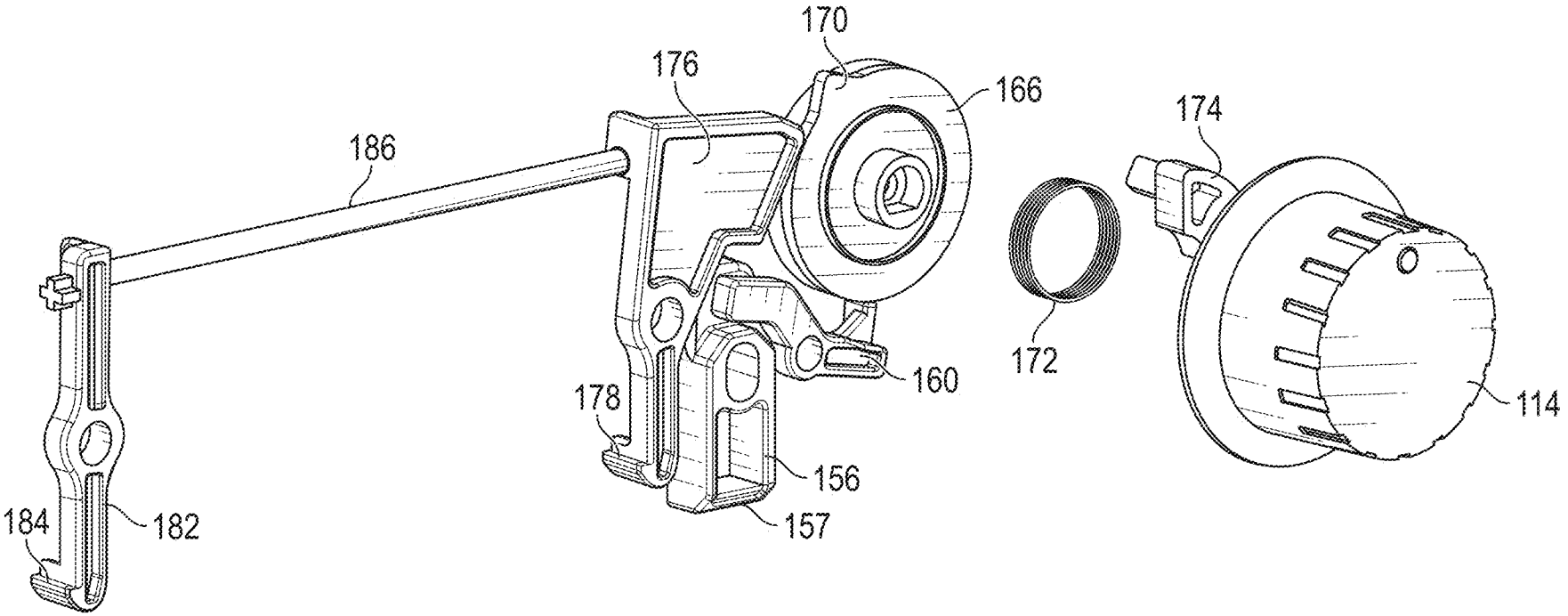
FIG. 16 is an exploded view of a control box from FIG. 15.
Figure 17:
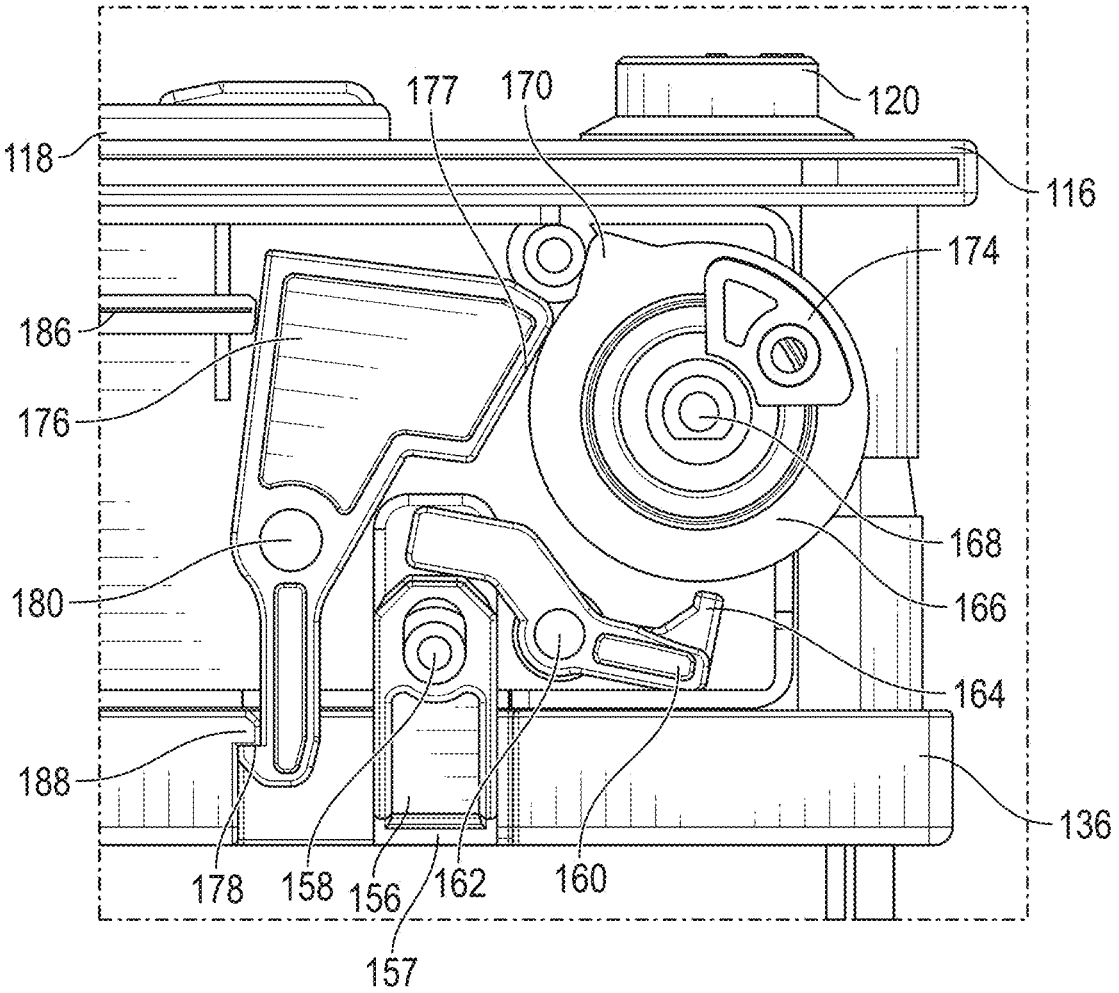
FIG. 17 is a front view of the control box shown in FIG. 16 coupled to one or more guiding posts and with certain parts removed to reveal internal components of the control box.

FIG. 16 is an exploded view of the control box 150 from FIG. 15. FIG. 17 is a front view of the control box 150 shown in FIG. 16 coupled to the one or more guiding posts 142*a*-142*d* and with certain parts removed to reveal internal components of the control box 150. In certain embodiments, the internal components of the control box 150 include one or more of a torsion spring 172, a spring tensioning block 174, a camwheel 166 with a cam 170 formed thereon, a swing arm 160 with a swing tooth 164 formed thereon (shown in FIG. 17), a locking pin 156 with a beveled edge 157 formed thereon, a first swing latch 176 with a first catch tip 178 formed thereon, a second swing latch 182 with a second catch tip 184 formed thereon, and a connection rod 186 connecting the first swing latch 176 to the second swing latch 182.

The functional aspects of the internal components of the control box 150 shown in FIG. 16 are further disclosed in FIG. 17. For example, in certain embodiments, the dial knob 114 is connected to the camwheel 170 by a shaft 168 which is rotatably attached to the back casing 152 of the control box 150. The dial knob 114 can also be connected to the spring tensioning block 174. As such, rotating the dial knob 114 will rotate the camwheel 170 to cause the spring tensioning block 174 to rotate around the shaft 168.

When the oven door 106 shown in FIG. 1 is open, e.g., when the player loads their dough animal into the oven to be "baked", the locking pin 156 is in a locked or up position which prevents the camwheel 166 from being rotated. In certain embodiments, a force applied by an upper edge of the oven door 106 to keep the locking pin 156 in the locked position is not present when the oven door 106 is opened. Thus, when opened, the locking pin 156 drops down while being guided by a sliding anchor 158. The swing arm 160 can be biased by a bias mechanism (not shown) to rotate counterclockwise, allowing the swing arm tooth 164 to engage with the camwheel 166 to prevent rotation of the camwheel 166. When the oven door 106 is closed, the camwheel 166 can be rotated.

When the oven door 106 is closed, the upper edge of the oven door 106 pushes on the beveled edge 157 of the locking pin 156 to force the locking pin 156 in an upward direction. For example, the upper edge of the locking pin 156 pushes on the left end of the swing arm 160 to rotate the swing arm about a pivot 162. This swing action of the swing arm 160 allows the swing tooth 164 to move out of engagement with the camwheel 166. As such, the user is free to rotate the camwheel 166 around the shaft 168. In some embodiments, when the swing tooth 164 is disengaged from the camwheel 166, a mechanism (not shown) prevents the oven door from being opened. As such during the "baking" time the oven door 106 the user is unable to open the oven door 106. In certain embodiments, the user can open the door when the dial is turned. In certain embodiments, the only locking feature is that the dial cannot be turned when the door is open.

When the user of the toy system 100 closes the oven door 106, the user can operate the oven by turning the dial knob 114 (e.g., clockwise or counter-clockwise), which causes the camwheel 166 and the spring tensioning block 174 to rotate together. The torsion spring 172 which can be connected to the camwheel 166 and the spring tensioning block 174. The torsion spring 172 can be tensioned as the user rotates the camwheel 166. When the user rotates the camwheel 166 to a certain clocking or point, the leading surface of the cam 170 contacts a ramped edge 177 on the first swing latch 176. In the embodiment shown in FIG. 16 and FIG. 17, the leading surface of the cam 170 contacts the ramped edge 177 of the first swing latch 176 when the camwheel 166 is rotated about 300°. Other embodiments can have different rotation angles without deviating from the scope of the disclosure. For example, in certain embodiments, the camwheel 166 (knob/dial) rotates to 90 degrees clockwise rotation to activate the release mechanism.

When the leading surface of the cam 170 meets the ramped edge 177 of the first swing latch 176, further rotation of the camwheel 166 will cause the leading surface of the cam 170 to push on the ramped edge 177 of the first swing latch 176. The force will cause the first swing latch 176 to rotate counterclockwise around a pivot 180 formed on the back casing 152. This rotational movement of the first swing latch 176 allows the first catch tip 178 formed on the first swing latch 176 to swing away from a first step edge 188 formed on the shelf 136, as shown in FIG. 17. At the same time, the rotational movement of the first swing latch 176 pushes on the connection rod 186 which in turn causes the second swing latch 182 to rotate around a pivot (not shown) formed on the back casing 152 and causes the second catch tip 184 formed on the second swing latch 182 to swing away from a second step edge or latch feature (not shown) formed on the shelf 136. The engagement of the first swing catch tip 178 with the first step edge 188 on the shelf 136 and the engagement of the second swing catch tip 184 with the second step edge (not shown) on the shelf 136 maintains the shelf 136 in the upper position. When the first and second swing latch tips 178 and 184 disengage with their respective step edges on the shelf 136, the shelf 136 is free to slide down along the guiding posts 142*a*-142*d*.

When the dial knob 114 is turned (e.g., clockwise) to a physical stop, a series of movement of the latches and shelfs occur. This physical stop can be different in different embodiments. In the embodiment presented with respect to FIG. 16 and FIG. 17, the physical stop happens when the dial knob 114 is turned about 330°. In certain other embodiments, the physical stop of the dial is at 95° clockwise rotation. At this point, the user can stop turning the dial knob 114. When the user removes their hand from the dial knob 114, the tensioned torsion spring 172 acts to rotate the camwheel 166 counterclockwise. The speed of the turning may be controlled by a friction mechanism in the control box 150 so that it takes a predetermined length of time to return the camwheel 166 to its original position. When the camwheel 166 is returned to the original position, the swing arm tooth 164 on the swing arm 160 engages the camwheel 166, causing a signal, e.g., a sound signal or a light signal, to be generated, telling the user that the "baking" process has concluded, and the oven door 106 can be opened.

Figure 18:
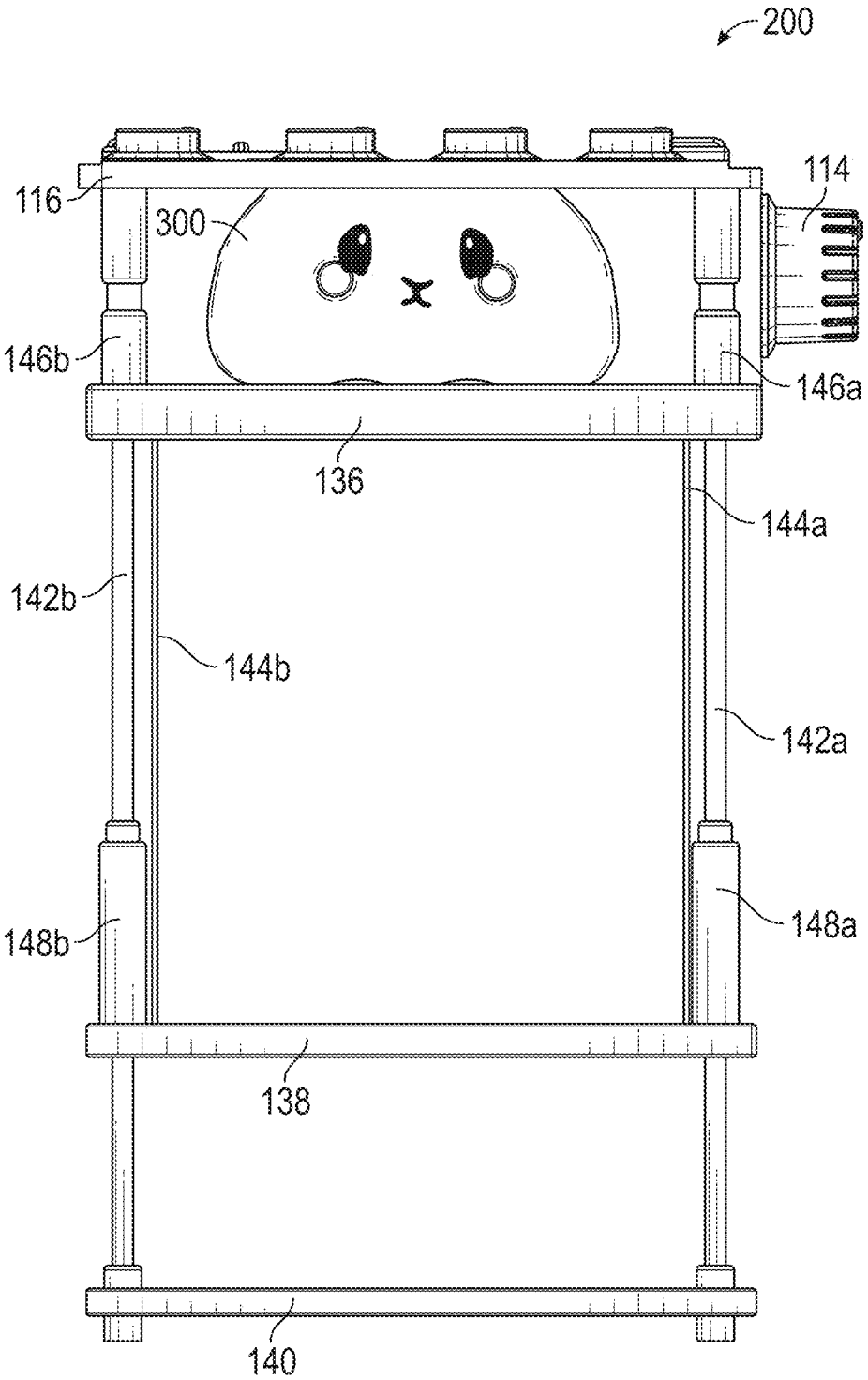
FIG. 18 is a left view of the internal structure shown in FIG. 10 with a plush doll disposed on a shelf which is located at an upper position.

FIG. 18 is a left view of the internal structure 200 shown in FIG. 10 with a plush doll 300 disposed on the shelf 136 which is located at an upper position. Referring to FIG. 18, when the toy system 100 is at its factory state, the shelf 136 is in the upper position. As shown in FIG. 16 and FIG. 17 and described above, the shelf 136 is kept in the upper position because the first swing catch tip 178 of the first swing latch 176 and the second swing catch tip 184 of the second swing latch 182 are engaged with the first step edge 188 and the second step edge on the shelf 136. Meanwhile, the shelf 138 is kept at a lower position by the string cords 144*a*-144*d*, each of which is tied to the shelf 136 at one end and to the shelf 138 at the other end. In the factory state of FIG. 18, the contents on the shelf 136 at the upper position is blocked from view by the upper panel 112 of the front wall 102 shown in FIG. 1. Therefore, if an object, e.g., a doll or toy 300 as shown in FIG. 18, is placed on the shelf 136, the user will not be able to see it because it is behind the upper panel 112. As described previously, the length of the string cords 144*a*-144*d* allows the shelf 138 to be located at the lower position, which is just below the lower edge of the oven door 106. Since the lower panel 104 on the front wall 102 gives the impression that it is openable, as described previously with FIG. 1, the user naturally considers that a storage space is partitioned behind the lower panel 104. Therefore, the user has the impression that the oven space behind the oven door 106 is bounded by the shelf 138 as its lower boundary. In certain embodiments as shown in FIG. 14B, the internal structure 200 comprises posts (e.g., molded posts) instead of string cords 144*a*-144*d*.

Figure 19:
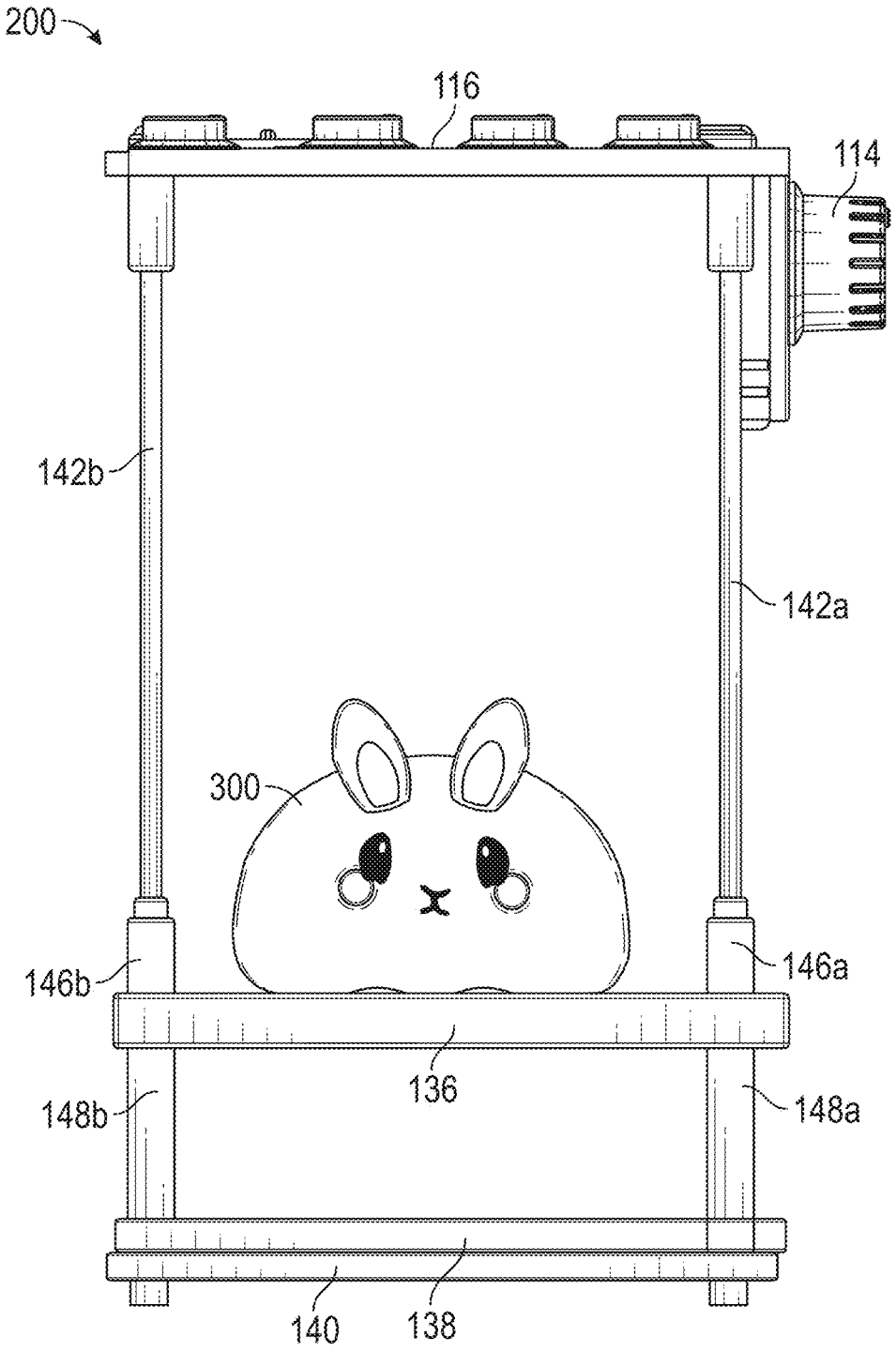
FIG. 19 is similar to FIG. 18 except the shelf and the plush doll have been slid in a downward direction along the one or more guiding posts to a lower position.

FIG. 19 is similar to FIG. 18 except the shelf 136 and the plush doll 300 have been slid in a downward direction along the one or more guiding posts 142*a*-142*d* to a lower position. FIG. 19 shows the state when the dial knob 114 is turned to the physical stop and the shelf 136 is dropped due to the force of gravity to the lower position. As described with respect to FIG. 16 and FIG. 17, when the user turns the dial knob 114 to a certain point, the camwheel 166 causes the first swing catch tip 178 of the first swing latch 176 and the second swing catch tip 184 of the second swing latch 182 to disengage from the first step edge 188 and the second step edge (not shown) on the shelf 136. Consequently, the shelf 136 slides down along the guiding posts 142*a*-142*d* from the upper position to the lower position. Meanwhile, the shelf 138 slides down due to gravity along the guiding posts 142*a*-142*d* and is dropped to a position on top of the oven base 140. Since the distance between the lower position and a bottom position where the shelf 138 is dropped to is shorter than the distance between the lower position and the upper position and the string cords 142*a*-142*d* are flexible, the shelf 138 is stacked right on top of the oven base 140, as shown in FIG. 19. In this way, in certain embodiments, the shelf 136 is dropped to exactly or about the lower position because the shelf 136 is supported by the bushings 148*a*-148*d* formed on the shelf 138. The length of the bushings 148*a*-148*d* are pre-determined to allow the shelf 138 to be at the lower position when dropped. Furthermore, the top surface of the shelf 136 and the top surface of the shelf 138 have the same appearance. Therefore, the user of the toy system 100 is given the impression that bottom surface has not changed. This switch from the shelf 138 to the shelf 136 at the same lower position during the "baking" process gives the user an impression of "baking" a toy, e.g., a plush doll. In certain embodiments as shown in FIG. 14B, the internal structure 200 comprises posts (e.g., molded posts) instead of string cords 144*a*-144*d*.

Figure 20:
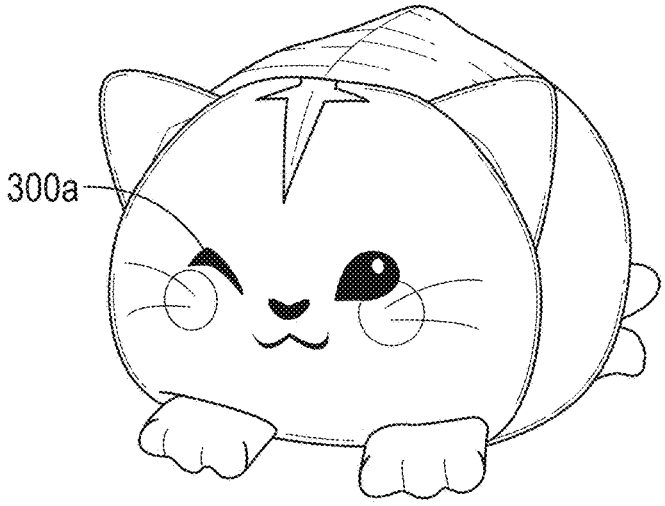
FIG. 20 shows an example embodiment of the plush doll formed as a cat.
Figure 21:
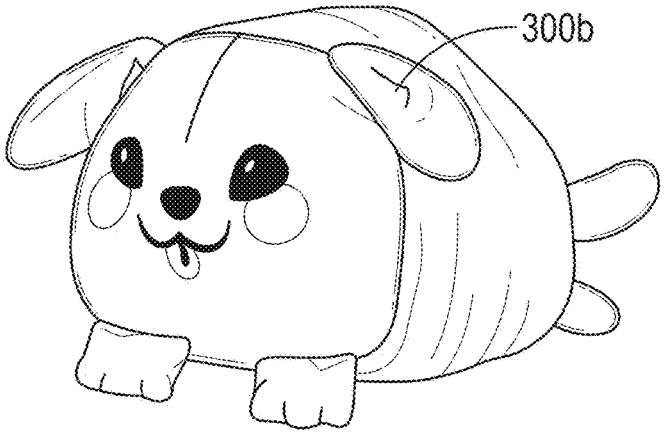
FIG. 21 shows another example embodiment of the plush doll formed as a dog.
Figure 22:
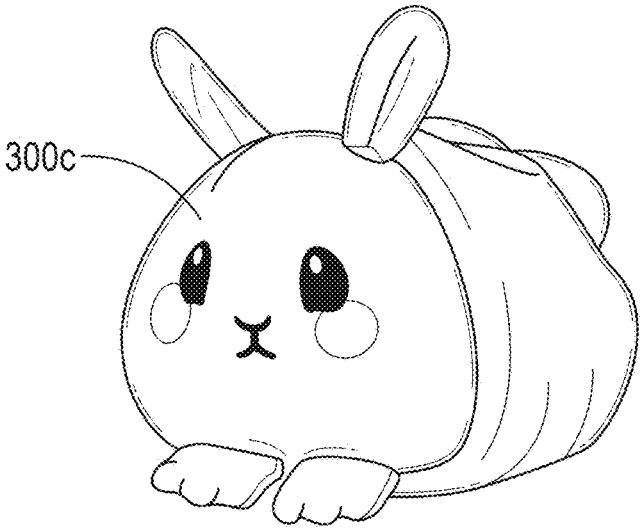
FIG. 22 shows another example embodiment of the plush doll formed as a rabbit.

The plush doll 300 shown in FIG. 18 and FIG. 19 can have different appearances. FIG. 20 shows an example embodiment of the plush doll 300*a* formed as a cat. FIG. 21 shows another example embodiment of the plush doll 300*b* formed as a dog. FIG. 22 shows another example embodiment of the plush doll 300*c* formed as a rabbit. All three plush dolls 300*a*-300*c* may have a general shape of a loaf of bread.

Figure 23:
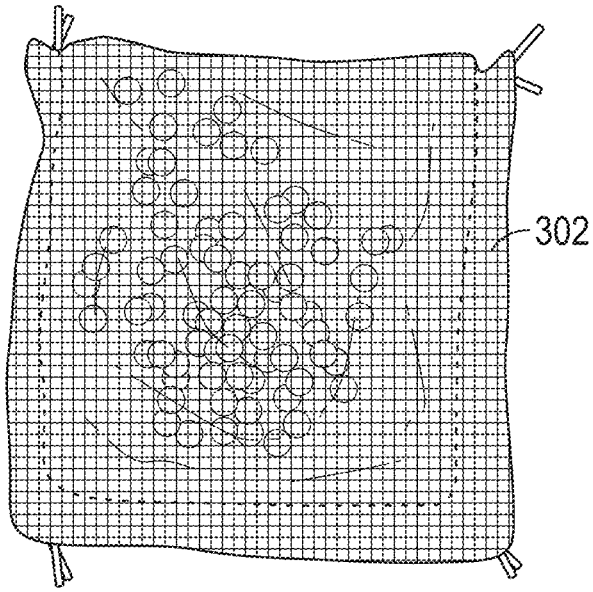
FIG. 23 shows a small bag of scent that can be loaded into any of the plush dolls shown in, for example, FIGS. 20-22.

FIG. 23 shows a small bag of scent 302 that can be loaded into any of the plush dolls 300 shown in, for example, FIGS. 20-22. To make toy making process more realistic, in certain embodiments, the "baking" process can be configured to emit a scent. For example, the scent can be emitted at a predetermined time during the baking process. The scent desirably matches the object being baked. For example, in certain embodiments, if the plush 300 is like a loaf of bread, the scent bag 302 can emit a bread scent.

Figure 24A:
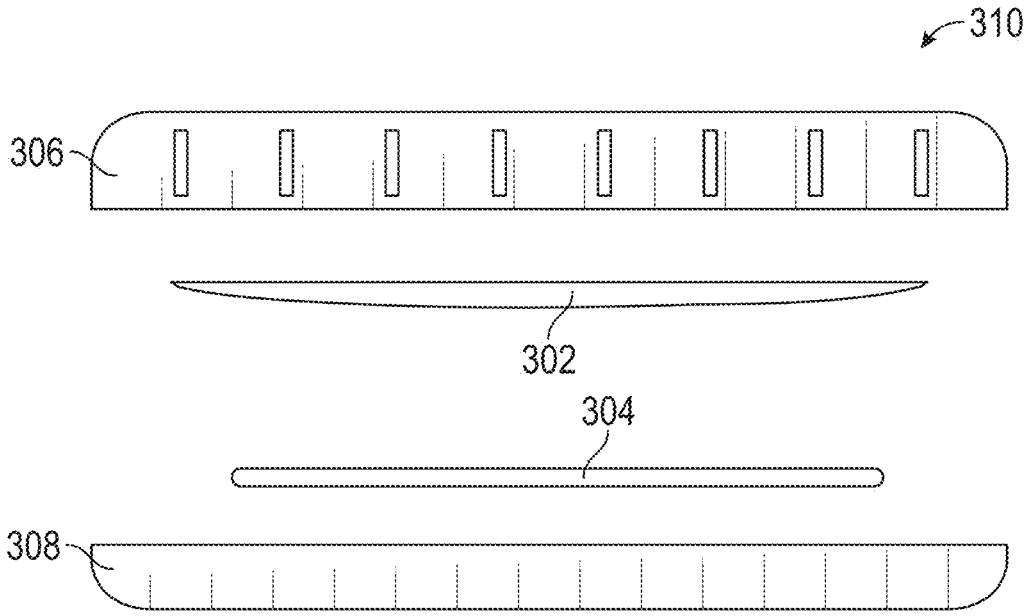
FIG. 24A is an exploded schematic view illustrating an embodiment of a module containing the scent bag shown in FIG. 23.

FIG. 24A is an exploded schematic view illustrating an embodiment of a module 310 containing the scent bag 302 shown in FIG. 23. In certain embodiments, the module 310 further comprises an upper case 306, a lower case 308, and a heater panel 304.

Figure 24B:
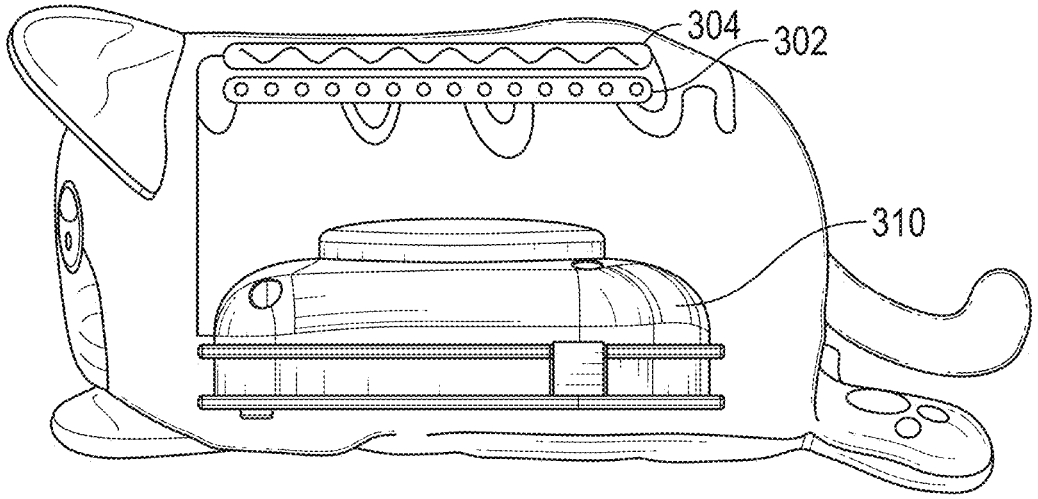
FIG. 24B illustrates an embodiment where the heater panel and scent pouch are located inside the plush, but outside of the electronic module.
Figure 24C:
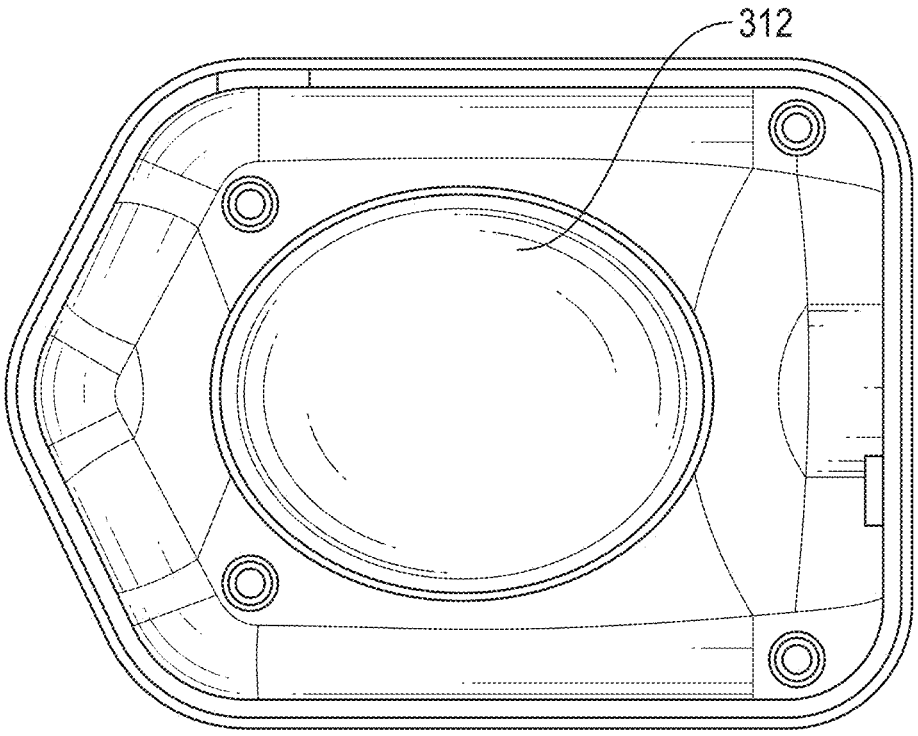
FIG. 24C is a top side view of the module from FIG. 24B.

FIG. 24B illustrates an embodiment where the heater panel 304 and scent pouch 302 are located inside the plush, but outside of an electronic module 310. In certain embodiments, the heater element 340 and/or scent pouch 302 are located inside the plush, underneath the top fabric surface. FIG. 24C is a top side view of the module 310 from FIG. 24B after being removed from the plush doll 300 and disconnected from the heater panel 304.

The module 310 and/or heater panel 304 can each include one or more sensors 312. The one or more sensors 312 can be any type of sensor known to a person having ordinary skill in the art. In certain embodiments, the sensor 312 is a mechanical sensor configured to sense when the plush doll 300 is being squeezed. In certain embodiments, activation of the sensor 312 causes the heater panel 304 to activate. In certain embodiments, activation of the sensor 312 causes the plush doll 300 to make sounds. In certain embodiments, activation of the sensor 312 causes the plush doll 300 to awake. In certain embodiments, the heater panel 304 includes another sensor 312 (e.g., thermistor) configured to control the temperature of the heater panel 304.

Figure 24D:
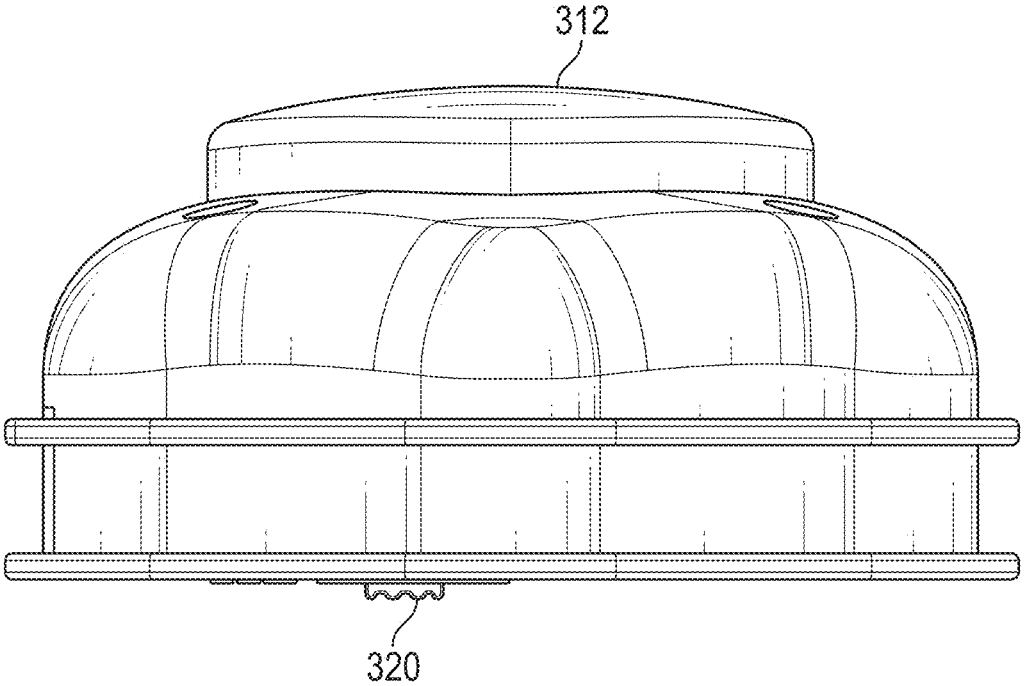
FIG. 24D is a front side view of the module from FIG. 24B.

FIG. 24D is a front side view of the module 310 from FIG. 24B and shows an exemplary position for an on/off switch 320. In certain embodiments, the module 310 includes a speaker 316. In certain embodiments, the speaker 316 is disposed on a bottom surface of the module 310 and emits sounds from the module 310.

Figure 24E:
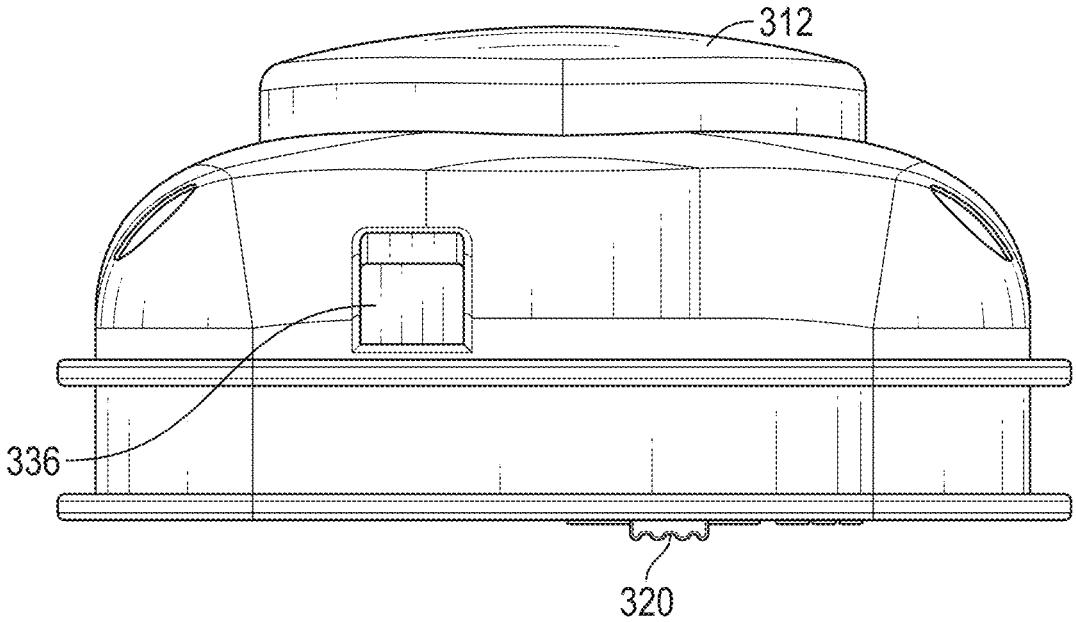
FIG. 24E is a back side view of the module from FIG. 24B.
Figure 24F:
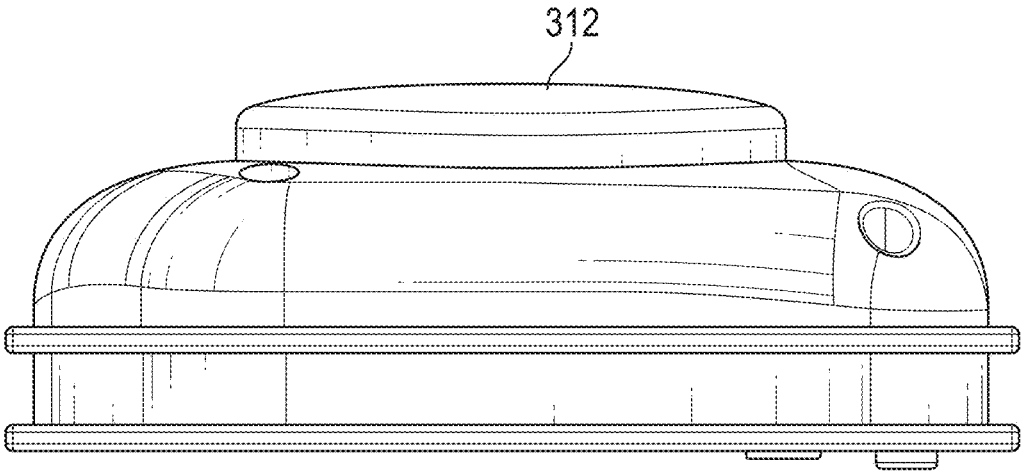
FIG. 24F is a left side view of the module from FIG. 24B.
Figure 24G:
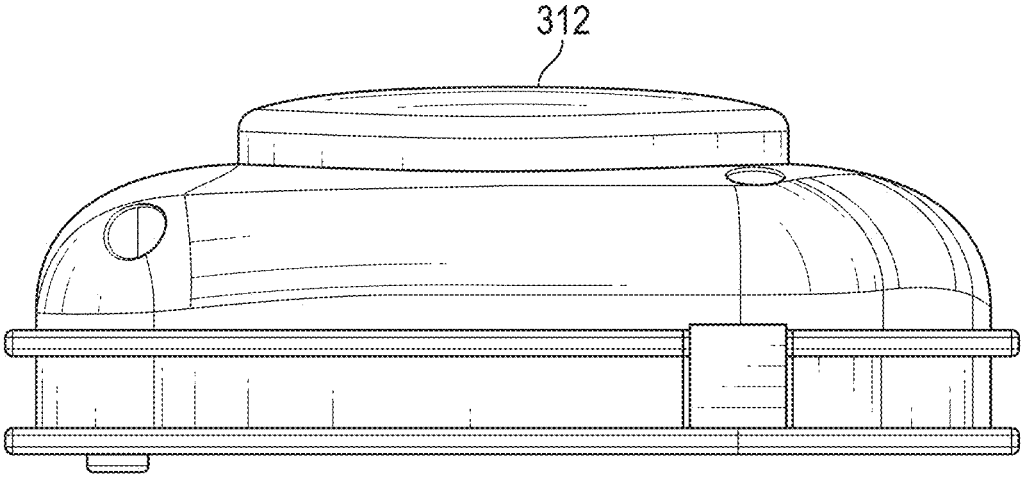
FIG. 24G is a right side view of the module from FIG. 24B.

FIG. 24E is a back side view of the module 310 from FIG. 24B and shows a connector 336. The connector 336 is configured to join electrical terminations to create an electrical circuit between the module 310 and the heater panel 304. In certain embodiments, the connector 336 is configured to removably connect to at least one wire 338 for providing power to the heater panel 304. FIG. 24F is a left side view of the module 310 from FIG. 24B. FIG. 24G is a right side view of the module 310 from FIG. 24B.

Figure 24H:
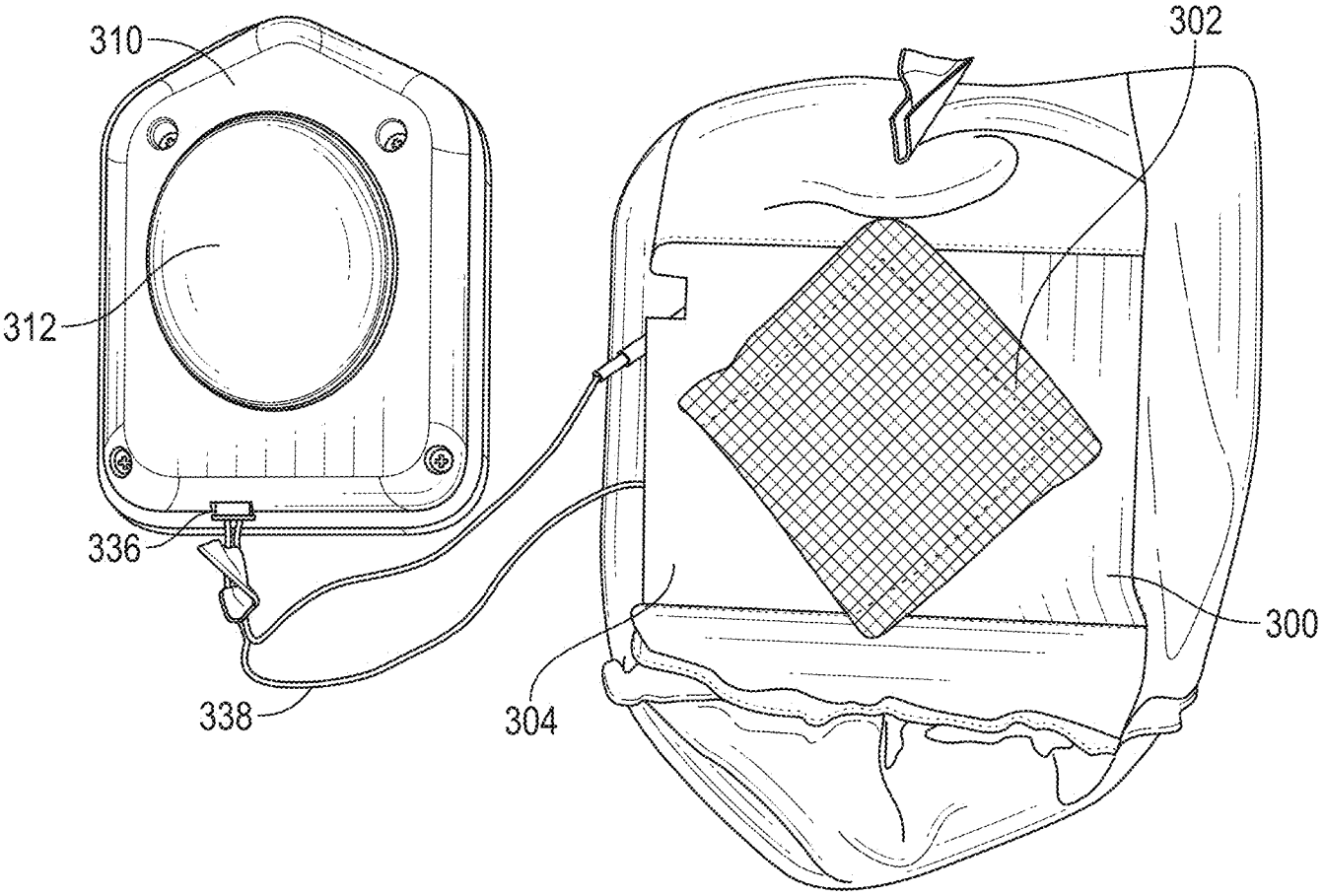
FIG. 24H shows the module removed from the plush doll of FIG. 24B and sitting next to a stack of the scent bag, heater panel, and plush doll turned inside out.

FIG. 24H shows the module 310 removed from the plush doll 300 of FIG. 24B and sitting next to a stack of the scent bag 302, the heater panel 304, and the plush doll 300 turned inside out. During use, the module 310, the heater panel 304, and the scent bag 302 are placed inside the plush doll 300. As is illustrated, the at least one wire 338 electrically connects the module 310 to the heater panel 304.

Figure 24I:
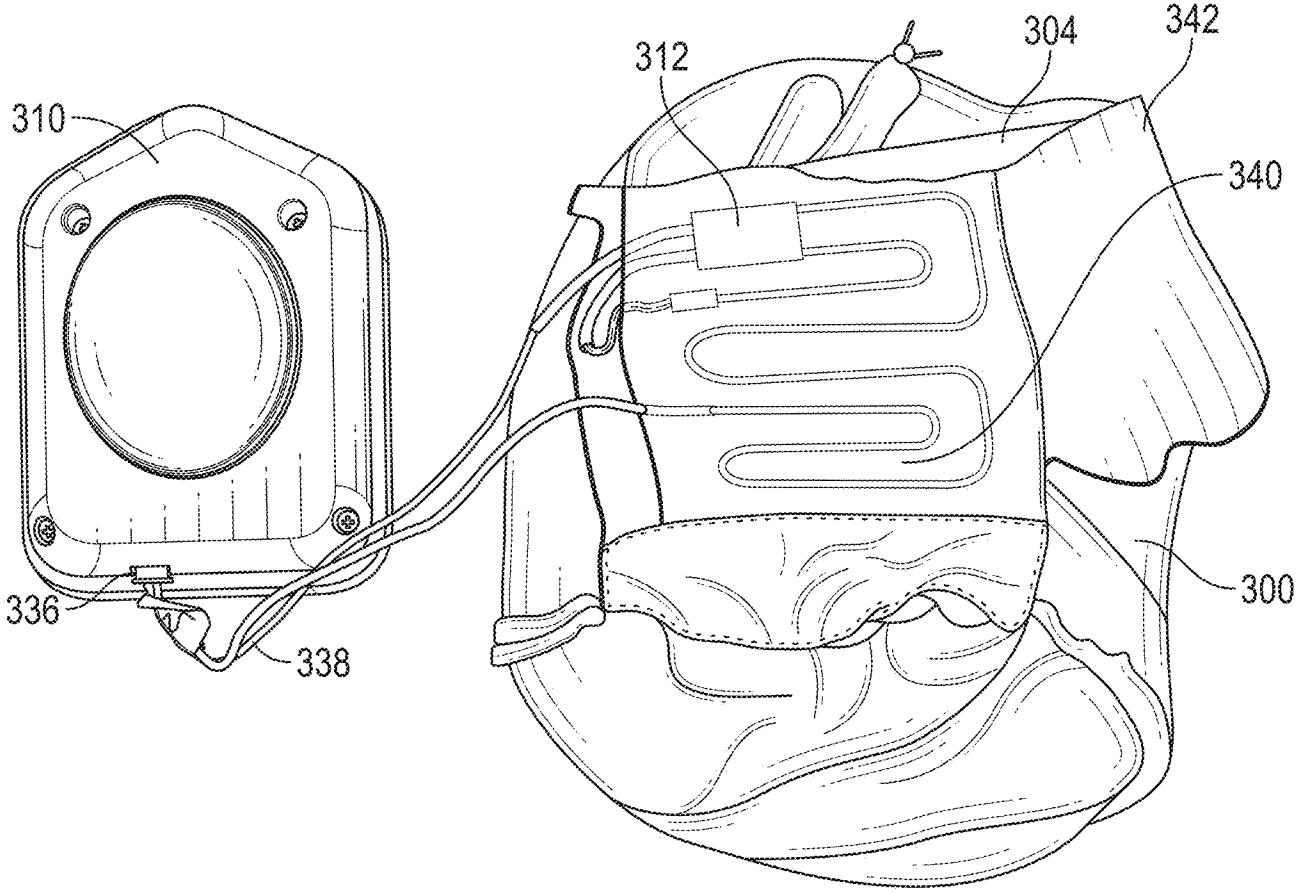
FIG. 24I is similar to FIG. 24H except the scent bag and a layer of the heater panel have been removed to show a heater element and a sensor (e.g., thermistor) within the heater panel.

FIG. 24I is similar to FIG. 24H except the scent bag 302 and a layer 342 of the heater panel 304 have been removed to more clearly show a heater element 340 and the sensor 312 (e.g., thermistor) within the heater panel 304. In certain embodiments, the module 310 and/or the heater panel 304 can each comprise one or more of the sensors 312. In certain embodiments, the sensor 312 of the heater panel 304 is configured as a thermistor. The sensor 312 can be configured to control or change the temperature of the heater panel 304.

Figure 25:
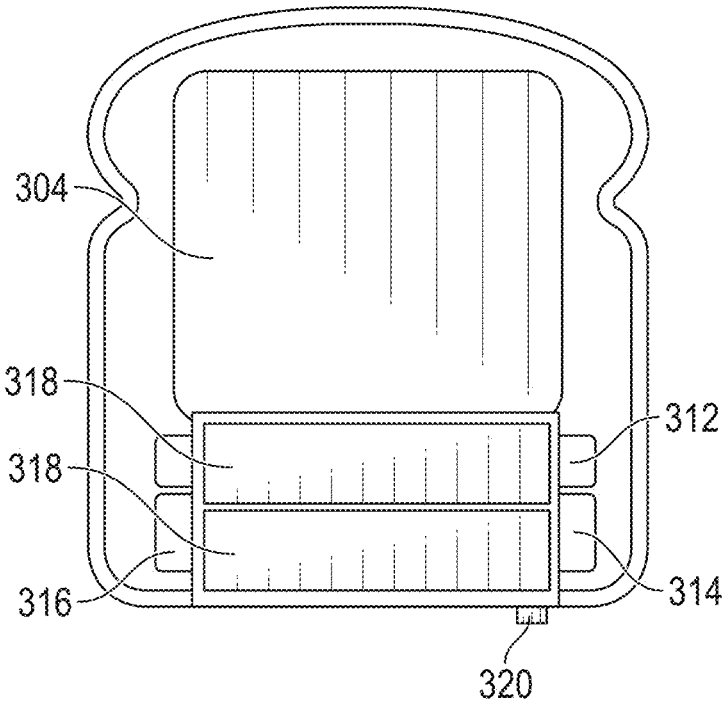
FIG. 25 is a front side schematic showing internal components of an assembled embodiment of the module from FIG. 24A shaped as a slice of bread.
Figure 26:
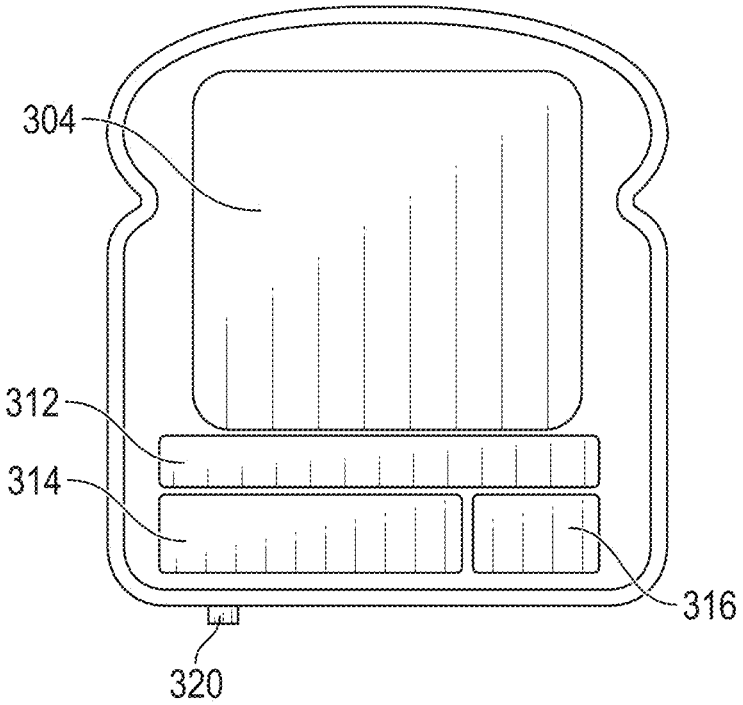
FIG. 26 is a back side schematic view of the module from FIG. 25.

FIG. 25 is a front side schematic showing internal components of an assembled embodiment of the module 310 from FIG. 24A shaped as a slice of bread. In other embodiments, the electronic module has a different shape. FIG. 26 is a back side schematic view of the module 310 from FIG. 25. The module 310 can further include one or more of a sensor 312, e.g., a capacitive sensor, a PCB 314 having circuitry and components integrated thereon, a speaker 316, a battery pack 318, and/or an on/off switch 320.

Figure 27:
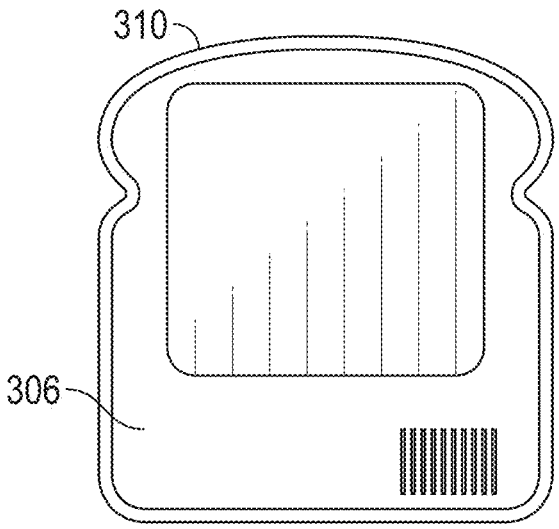
FIG. 27 is a front side view of the module of FIG. 25.
Figure 28:
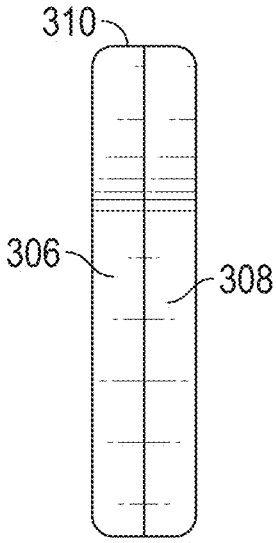
FIG. 28 is a side view of the module of FIG. 25.

FIG. 27 is a front side view of the module 310 of FIG. 25. FIG. 28 is a side view of the module 310 of FIG. 25. In certain embodiments, the module 310 comprises an upper case 306 and a lower case 308. Of course, the outer appearance can be different for different embodiments.

Figure 29:
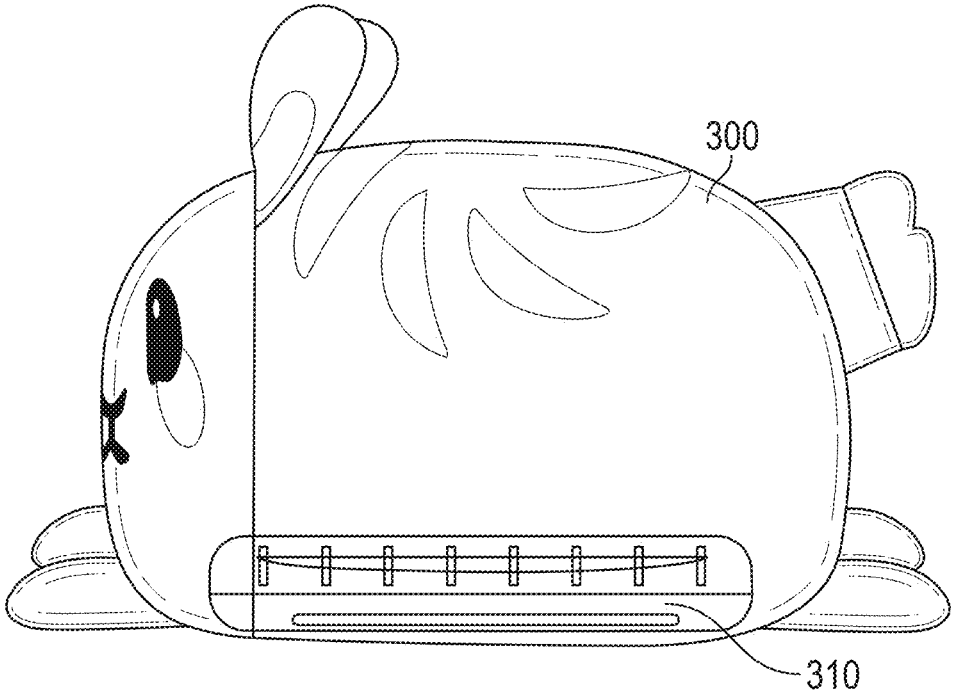
FIG. 29 schematically illustrates an embodiment of the integration of the module in FIG. 24A into the plush doll of FIG. 22. Another location of the scent and heater panel in the plush is shown in FIG. 24B.
Figure 30:
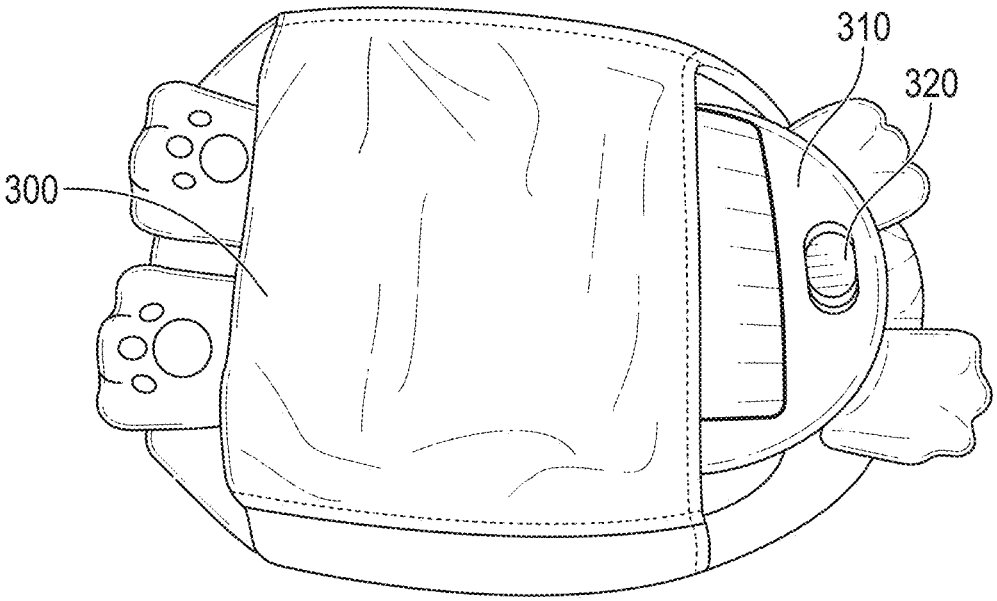
FIG. 30 is a bottom view of the plush doll from FIG. 29 showing the module disposed in a pocket of the plush doll. In certain embodiments, only the electronic module is located in the accessible pocket.

FIG. 29 schematically illustrates the integration of the module 310 in FIG. 24 into the plush doll 300 of FIG. 22. FIG. 30 is a bottom view of the plush doll 300 from FIG. 29 showing the module 310 disposed in a pocket of the plush doll 300. In other embodiments, the heater pad and scent pouch are located inside the plush, but outside of the electronic module as shown in FIG. 24B. In certain embodiments, the on/off switch 320 is exposed for easy access.

Figure 33:
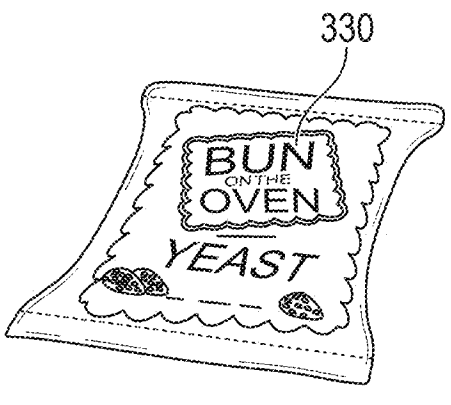
FIG. 33 shows a small bag of yeast which can be used as a dough making ingredient.
Figure 32:
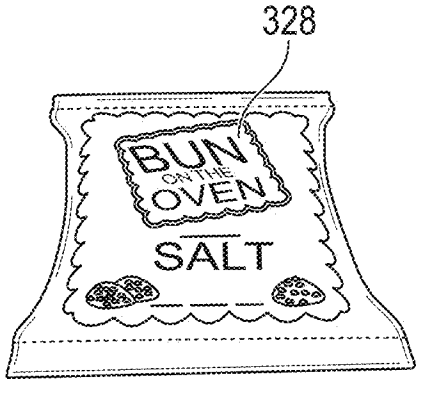
FIG. 32 shows a small bag of salt which can be used as a dough making ingredient.
Figure 31:
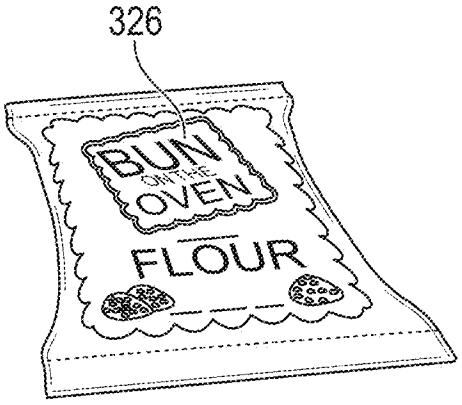
FIG. 31 shows a small bag of flour which can be used as a dough making ingredient.

To increase the curiosity and the involvement of the user to the open box experience, ingredients to make the toy through the "baking" process may be provided in the toy system 100. FIG. 31 shows a small bag of flour 326 which can be used as a dough making ingredient. FIG. 32 shows a small bag of salt 328 which can be used as a dough making ingredient. FIG. 33 shows a small bag of yeast 330 which can be used as a dough making ingredient. In some embodiments, the dough making compounds can be provided and may be packaged in an ingredient box.

Figure 34:
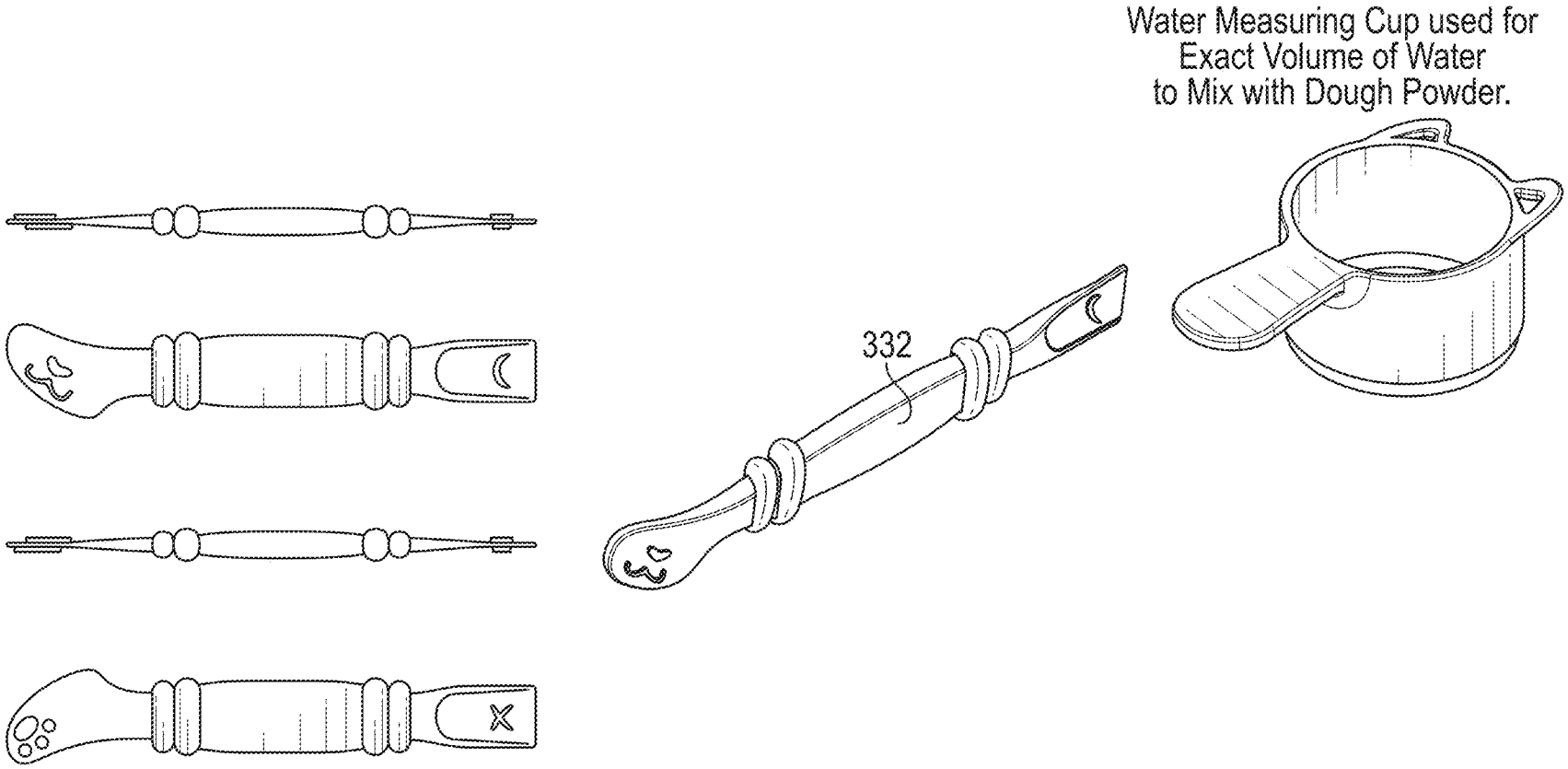
FIG. 34 shows different views of a dough sculpting tool than can used to shape the dough compound into a shape as well as shows a water measuring cup. The water cup is sized to hold the correct amount of water for the user to mix with the dough powder.

FIG. 34 shows different views of a dough sculpting tool 332 than can used to shape the dough compound into a shape. In certain embodiments, the ingredient bags 326, 328 and 330 and the sculpting tool 332 can be shrink wrapped on the toy system 100, so that the user player will notice their existence once the toy system 100 is opened. Or ingredient bags 326, 328 and 330 and the sculpting tool 332 can be stored on the shelf 138 inside the oven of the toy system 100. FIG. 34 further shows a water measuring cup. The specific water cup can be sized to hold the correct amount of water for the user to mix with the dough powder.

In some embodiments, during the process of unboxing the toy system 100 to access the toy inside the oven, the user or a group of users are advised to follow certain steps. In some embodiments, when the user opens the packaging, the user locates the toy system 100, a user's manual, and maybe some small bags. In some embodiments, by reading the user's manual, the user knows the steps of play to reveal and get the toy or plush doll 300. In some embodiments, the user can follow the following steps to play.

Locate the ingredients 326-330 and the sculpting tool 332. The ingredients 326-330 and tool 332 may be small bags or a small box inside the package of the toy system 100. In some embodiments, the ingredient bags 326-330 and the sculpting tool 332 are kept inside the oven on the shelf 138. In this case, the user needs to open the oven door 106 and remove them. In other embodiments, the outer shrink-wrap layer of the toy system 100 is torn open to get the play ingredients 326-330 and the sculpting tool 332.

Figure 37:
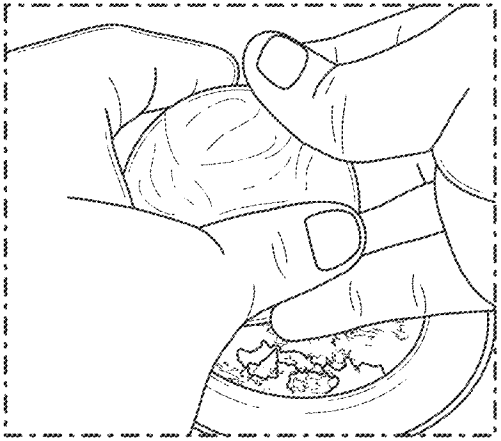
FIG. 37 shows the forming of a shape from the dough compound mixed in FIG. 36.
Figure 36:
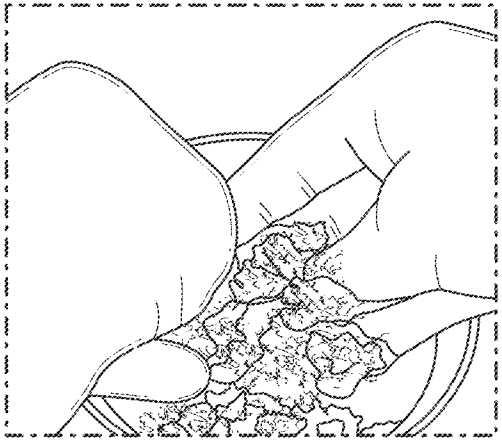
FIG. 36 shows the mixing of the dough ingredients in FIG. 35 with the water. The water cup illustrated in FIG. 34 can be used to ensure the correct amount of water is added to the dough powder.
Figure 35:
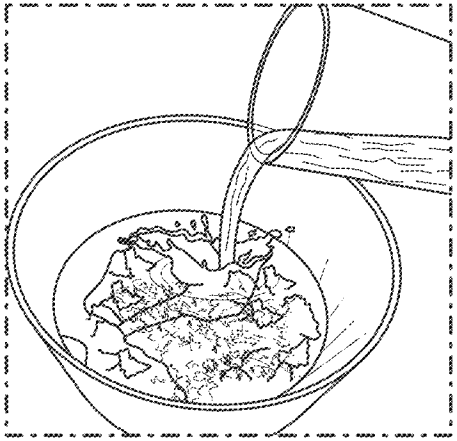
FIG. 35 shows the pouring of water into a bowl that contains one or more dough ingredients.
Figure 38:
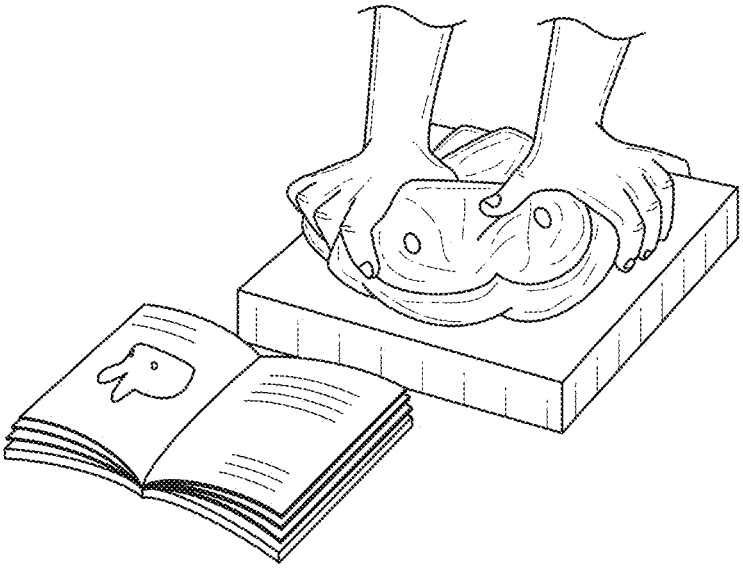
FIG. 38 schematically shows kneading the dough compound with hands on a cutting board.

Make the dough. The following order may be followed. First, empty the bags of ingredients, e.g., 326-330 into a bowl. Then add water to the ingredients and mix to form a dough compound. In certain embodiments, the specific water cup (FIG. 34) can be sized to hold the correct amount of water for the user to mix with the dough powder. The user can use his/her fingers and hands to mix and knead the dough compound, as shown in FIGS. 35-38. FIG. 35 shows the pouring of water into a bowl that contains one or more dough ingredients. FIG. 36 shows the mixing of the dough ingredients in FIG. 35 with the water. FIG. 37 shows the forming of a shape from the dough compound mixed in FIG. 36. FIG. 38 schematically shows kneading the dough compound with hands on a cutting board.

Figure 39:
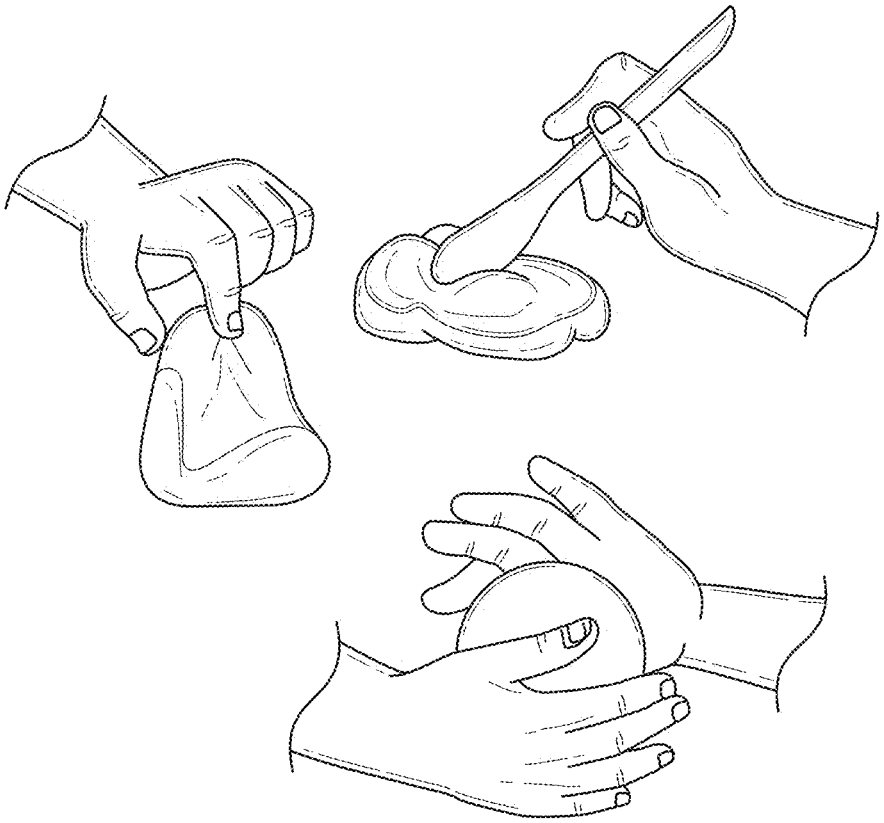
FIG. 39 schematically shows techniques for forming the dough compound into the desired shape using the dough sculpting tool from FIG. 34.
Figure 40A:
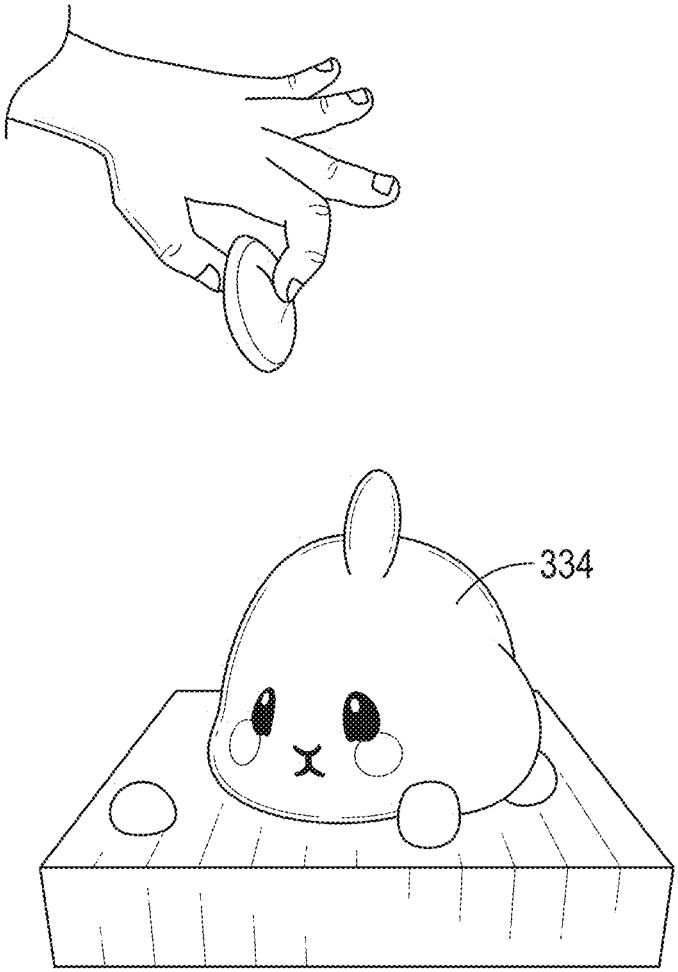
FIG. 40A schematically shows a user attaching an ear made from the dough compound to a body of a dough animal so as to form the shape of a rabbit.
Figure 40B:
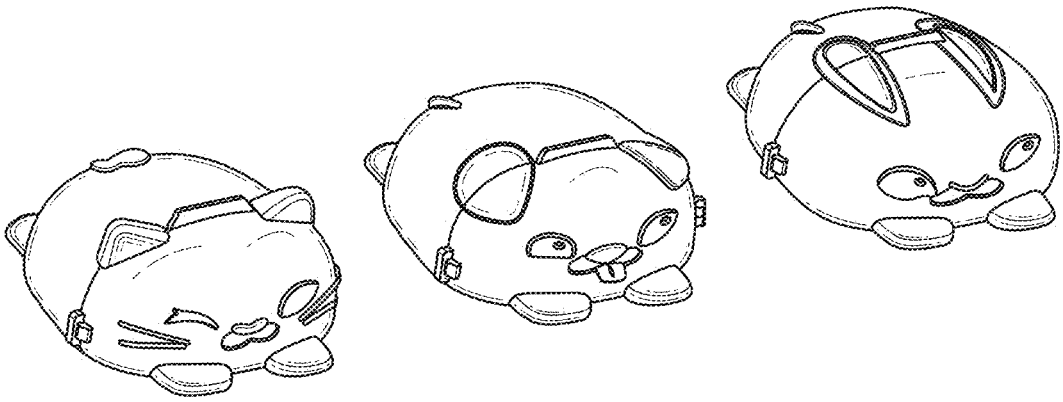
FIG. 40B shows specific dough molds that can be employed by the user to create the desired shape.

Created a dough animal shape. The user can use their hands and the sculpting tool 332 to work on the dough and form the dough into an animal FIG. 334, as illustrated in FIG. 39 and FIG. 40A. In certain embodiments as shown in FIG. 40B, a specific dough mold can be employed to create the desired shape. FIG. 39 schematically shows techniques for forming the dough compound into the desired shape using the dough sculpting tool from FIG. 34. FIG. 40A schematically shows a user attaching an ear made from the dough compound to a body of a dough animal so as to form the shape of a rabbit. Creating the dough animal shape may develop the user's artistic interest and skills. If the toy to be "baked" is in another form, the manual shipped with the toy system 100 may advise the user to form the dough into a specific animal shape.

Figure 41:
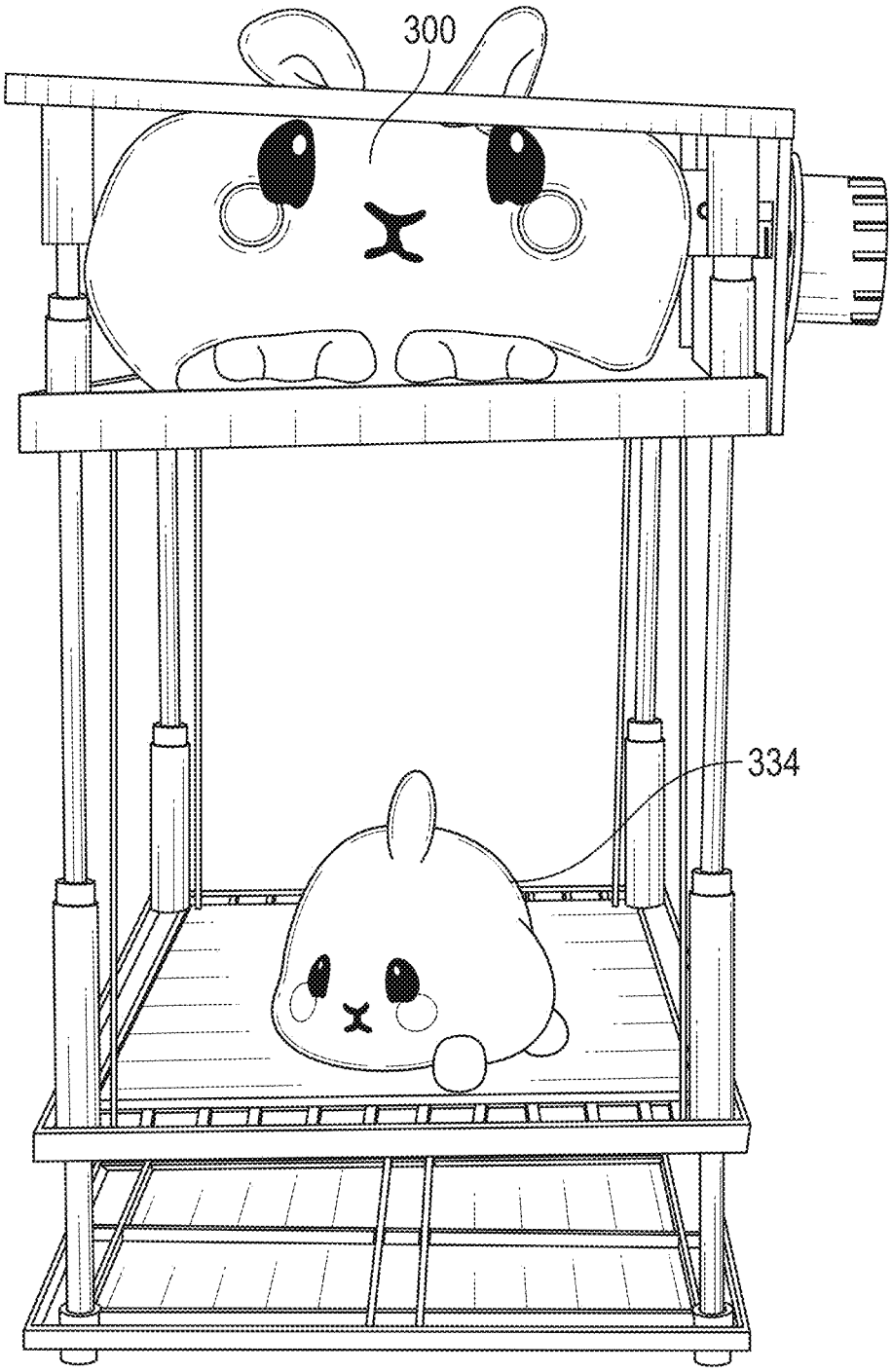
FIG. 41 shows the internal structure of FIG. 10 with the dough animal on the shelf below the shelf supporting the plush doll. The shelf is in the upper position and the other shelf is in the lower position.

FIG. 41 shows the internal structure of FIG. 10 with the dough animal 334 on the shelf 138 below the shelf 136 supporting the plush doll 300. The shelf 136 is in the upper position and the other shelf 138 is in the lower position. The user can place the dough into the oven. The user opens the oven door 106 and places the dough animal 334 they created on the shelf 138 and closes the oven door 106. In certain embodiments, the toy system 100 is shipped with the plush doll 300 stored on the shelf 136. At the factory state, the shelf 136 is kept at the upper position and is hidden behind the upper panel 112 of the front wall 102. In certain embodiments, the shelf 138 is kept at the lower position by the string cords 144*a*-144*d*. The lower position is just below the lower edge of the oven door 106. In certain embodiments, a plurality of guide posts (FIG. 14B) are employed instead of string cords 144*a*-144*d*.

Figure 42:
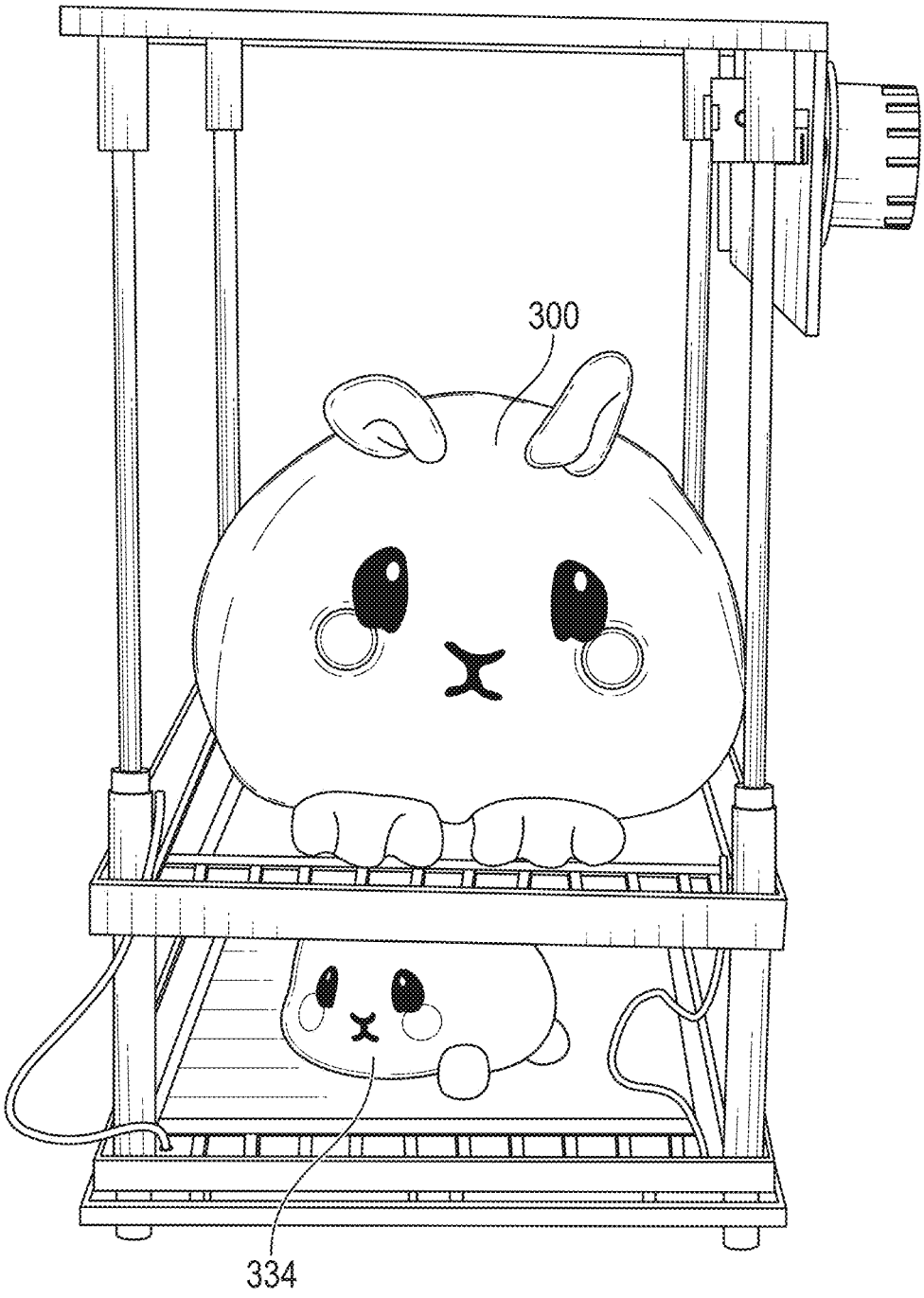
FIG. 42 is similar to FIG. 41 except the shelf supporting the plush doll has been slid in a downward direction to the lower position and the shelf supporting the dough animal has been slid to the bottom position. In this way, the plush doll has taken the place of the dough animal behind the oven door.

FIG. 42 is similar to FIG. 41 except the shelf 136 supporting the plush doll 300 has been slid in a downward direction to the lower position and the shelf 138 supporting the dough animal 334 has been slid to the bottom position. In this way, the plush doll 300 has taken the place of the dough animal 334 behind the oven door 106. The user can, for example, turn the dial knob 114 to start the "baking" process. In certain embodiments, the dial knob 114 is to be rotated for approximately 330° for the camwheel 166 to push on the first swing latch 176. In certain embodiments, the camwheel 166 (knob/dial) is rotated to 90 degrees clockwise rotation to activate the release mechanism. The force allows the shelf 136 to drop down to the lower position and the shelf 138 to drop down to the bottom position and stack with the oven base 140. Consequently, the dough animal 334 is dropped together with the shelf 138 and is hidden behind the lower panel 104 on the front wall 102. Desirably, the mechanism connected with the dial knob 114 prevents the oven door 106 from being opened during the step. As such the user does not know the changes occurring inside the oven.

The user can wait for the "baking" process to finish. The dial knob 114 rotates backwards due to the potential energy stored in the torsion spring 172 when the dial knob 114 was turned clockwise. The process may be accomplished by a baking signal, e.g., a ticking sound or an LED light. The baking process may take about 2 minutes, or another predetermined length of time.

The user can remove the toy 300 from the oven. When the dial knob 114 is returned to the original position, the "baking" process is finished and a ready signal is generated, e.g., a ready sound signal or a ready light signal. The user may open the oven door 106 to remove the plush toll 300. Desirably, there is mechanism inside the oven to turn the on/off switch 320 to on, so that the heater panel is turned on to warm up the plush doll 300 and the make the scent bag release bread scent. In other embodiments, the on/off switch 320 can be turned on immediately after the plush doll 300 is removed from the oven. For example, if the user is a child, a parent of the child can turn on the on/off switch 320. The heater panel 304 in the plush toll 300 can be programmed to power on for a predetermined length of time, e.g., 5 minutes.

After play, the toy system 100 can be restored to its original state so that it can be played again. This can be done by turning the on/off switch 320 on the plush doll 300 off and then on, and place the plush doll 300 in the oven on the shelf 136, which is at the lower position. Then lift up the shelf 136 so that the step edges on the shelf 136 engage with the catch tips 178 and 184 on the swing latches 176 and 182. Consequently, the shelf 138 is pulled up to the lower position by the string cords 144*a*-144*d*. The user can remove the dough animal 334 created before from the shelf 138 and close the oven door 106. The mechanism is reset and the toy system 300 is ready to be played again. In certain embodiments as shown in FIG. 14B, the internal structure 200 comprises posts (e.g., molded posts) instead of string cords 144*a*-144*d*.

Figure 43:
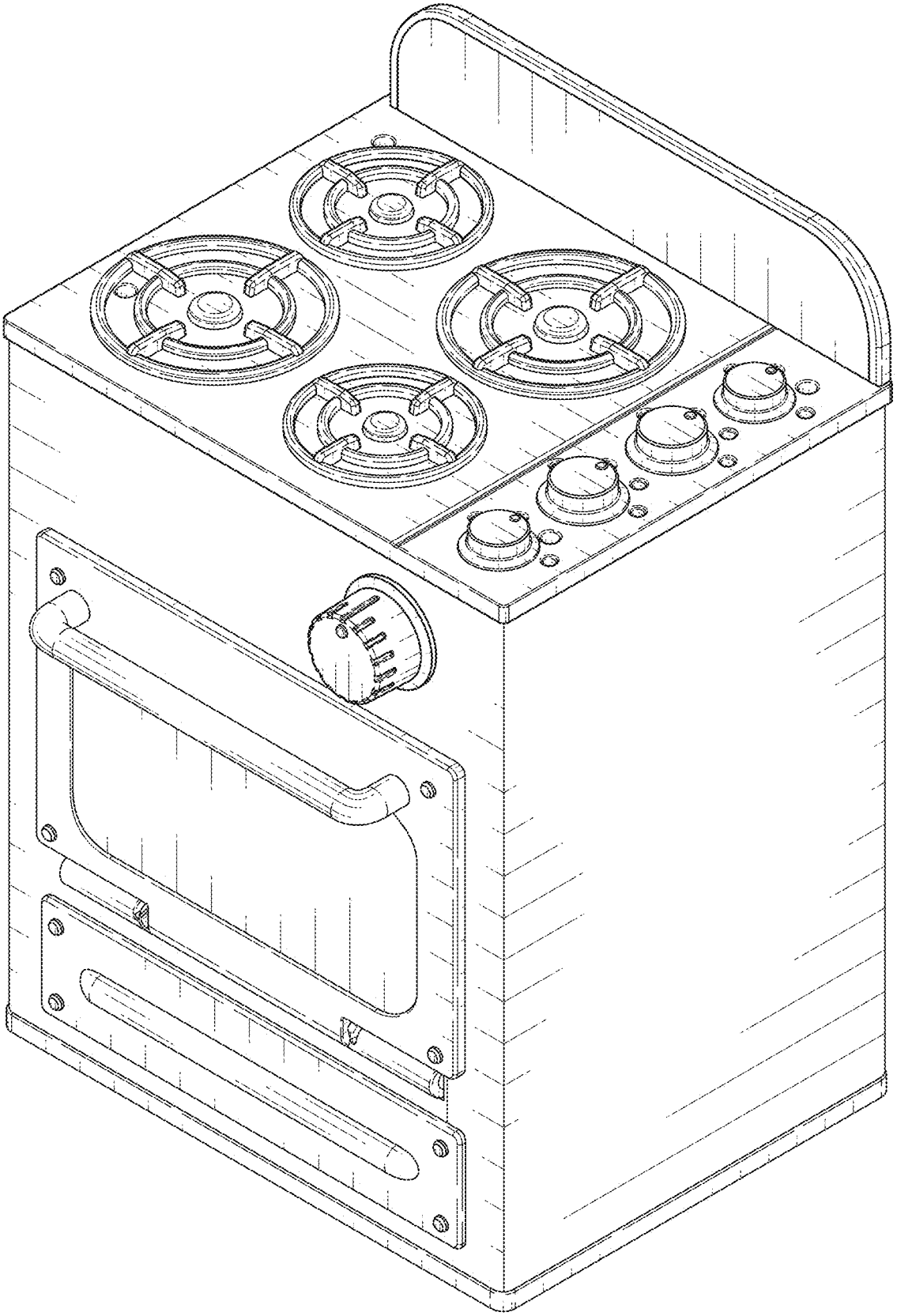
FIG. 43 is a front, right, top perspective view of an embodiment of the toy system.
Figure 44:
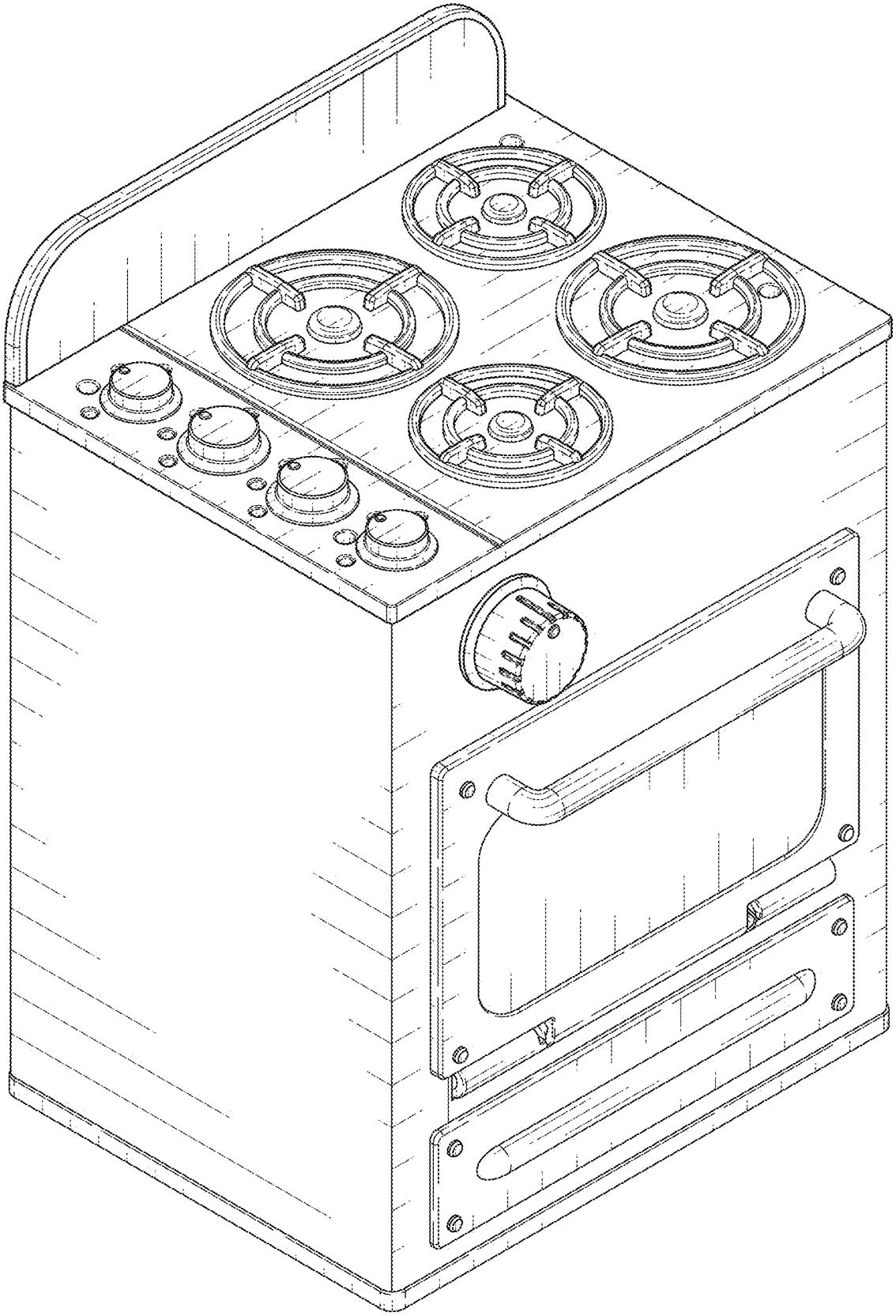
FIG. 44 is a front, left, top perspective view of the toy system of FIG. 43.
Figure 45:
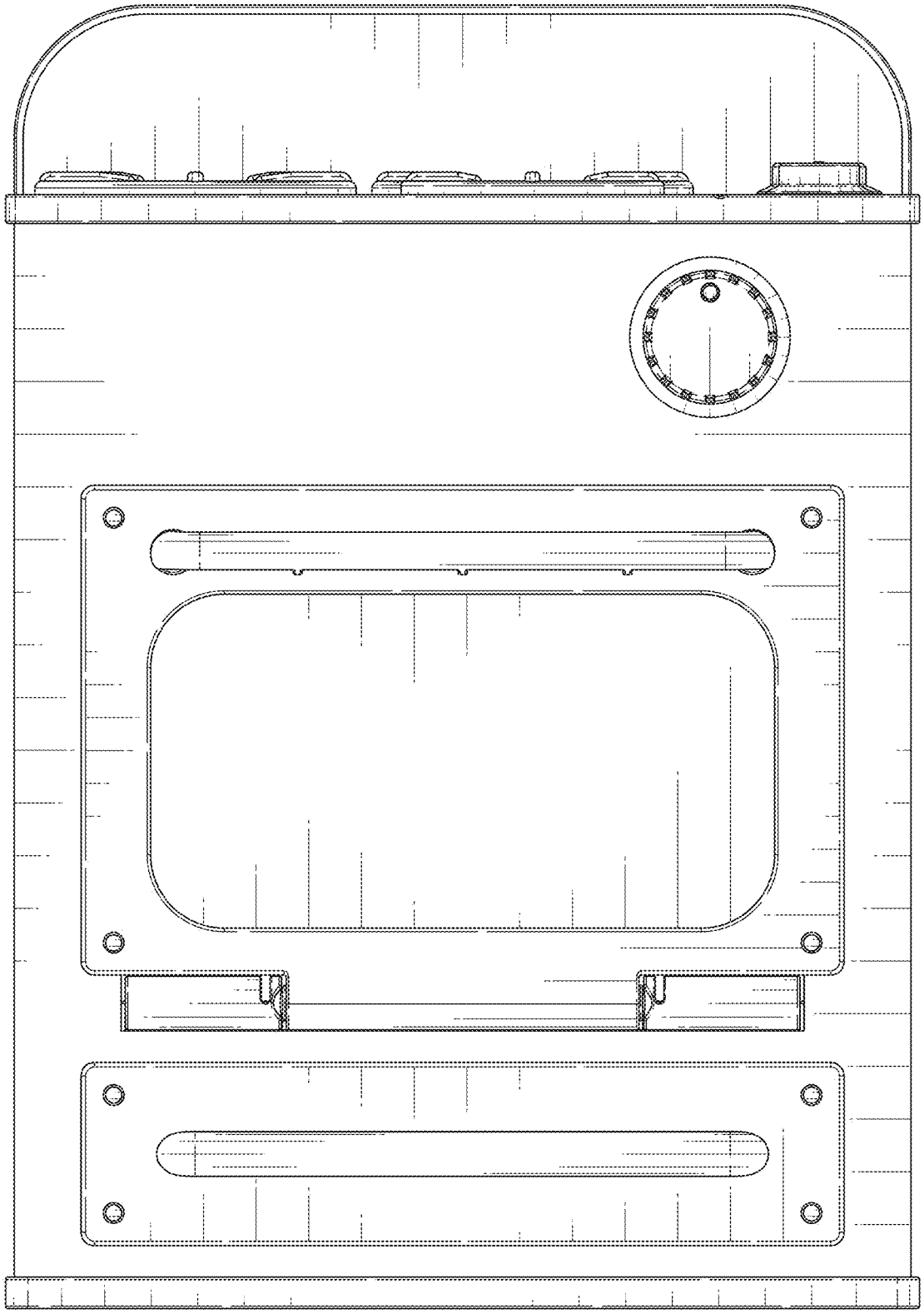
FIG. 45 is a front plan view of the toy system of FIG. 43.
Figure 46:
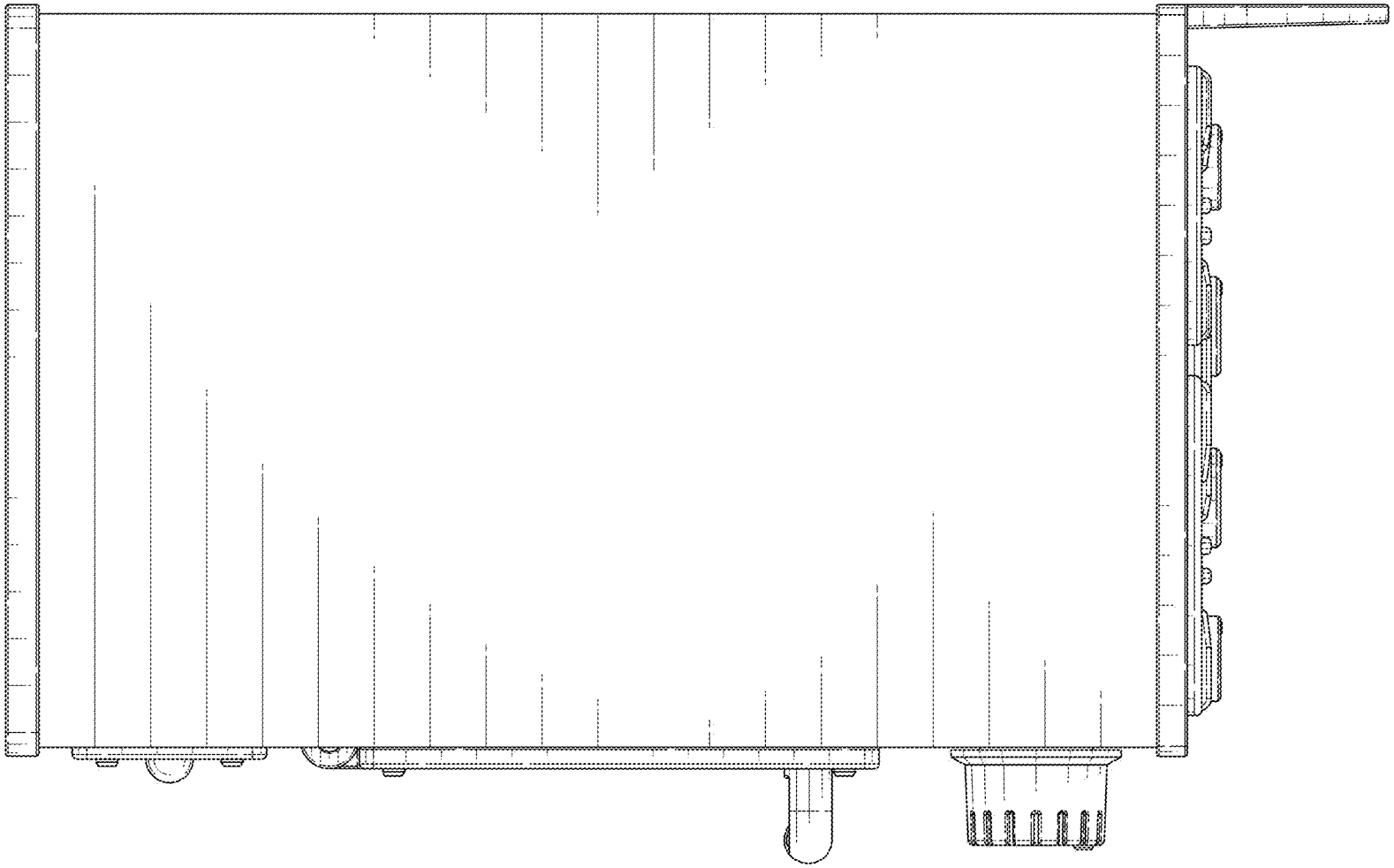
FIG. 46 is a left-side plan view of the toy system of FIG. 43.
Figure 47:
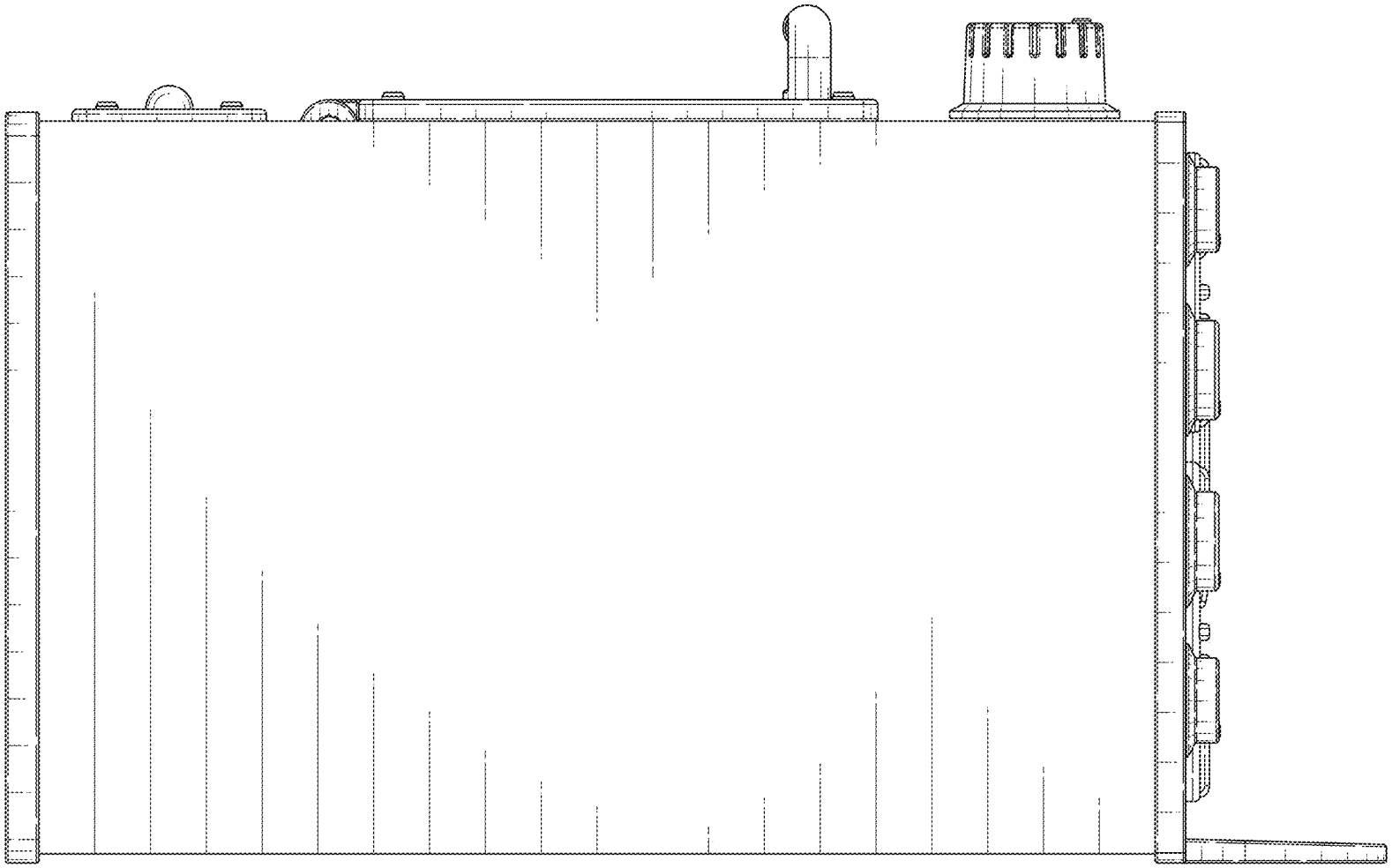
FIG. 47 is a right-side plan view of the toy system of FIG. 43.
Figure 48:
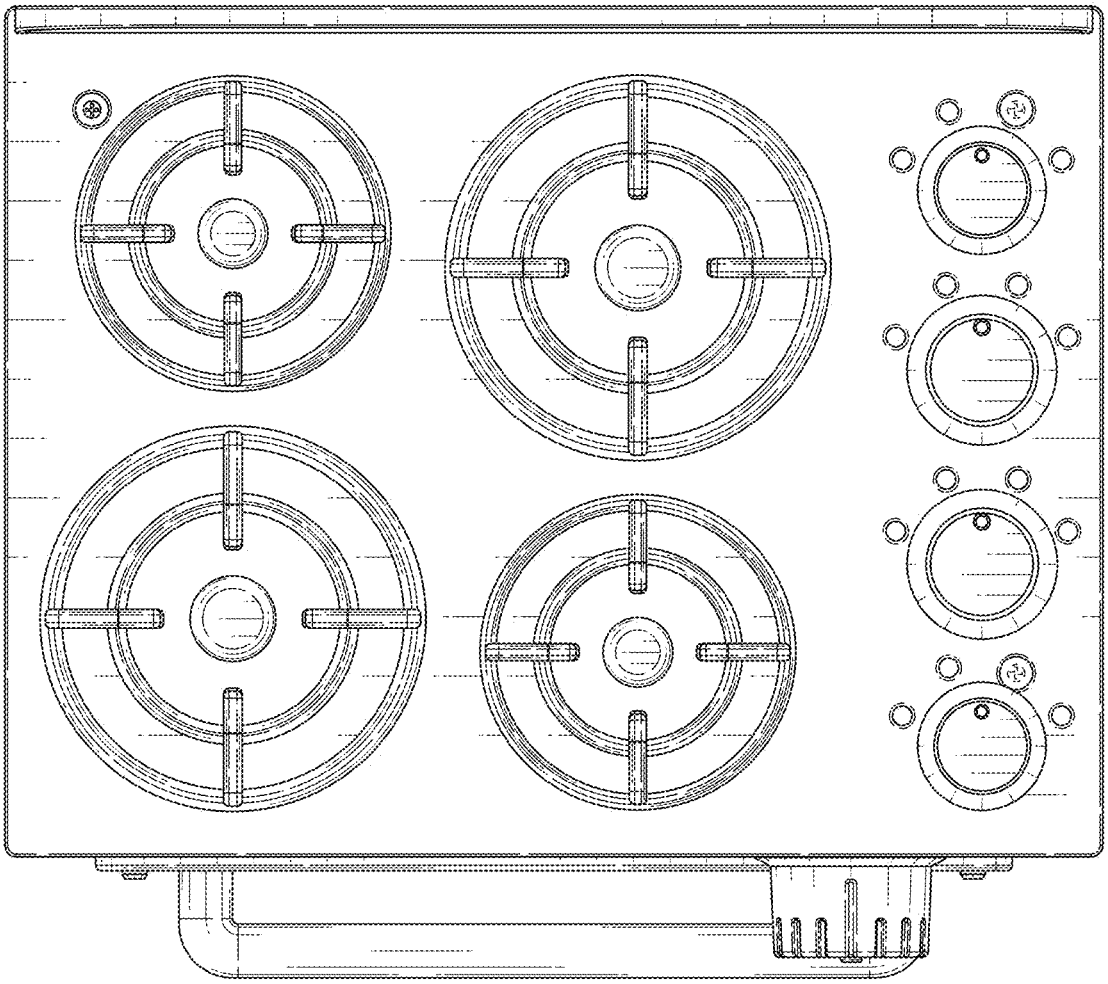
FIG. 48 is a top plan view of the toy system of FIG. 43.
Figure 49:
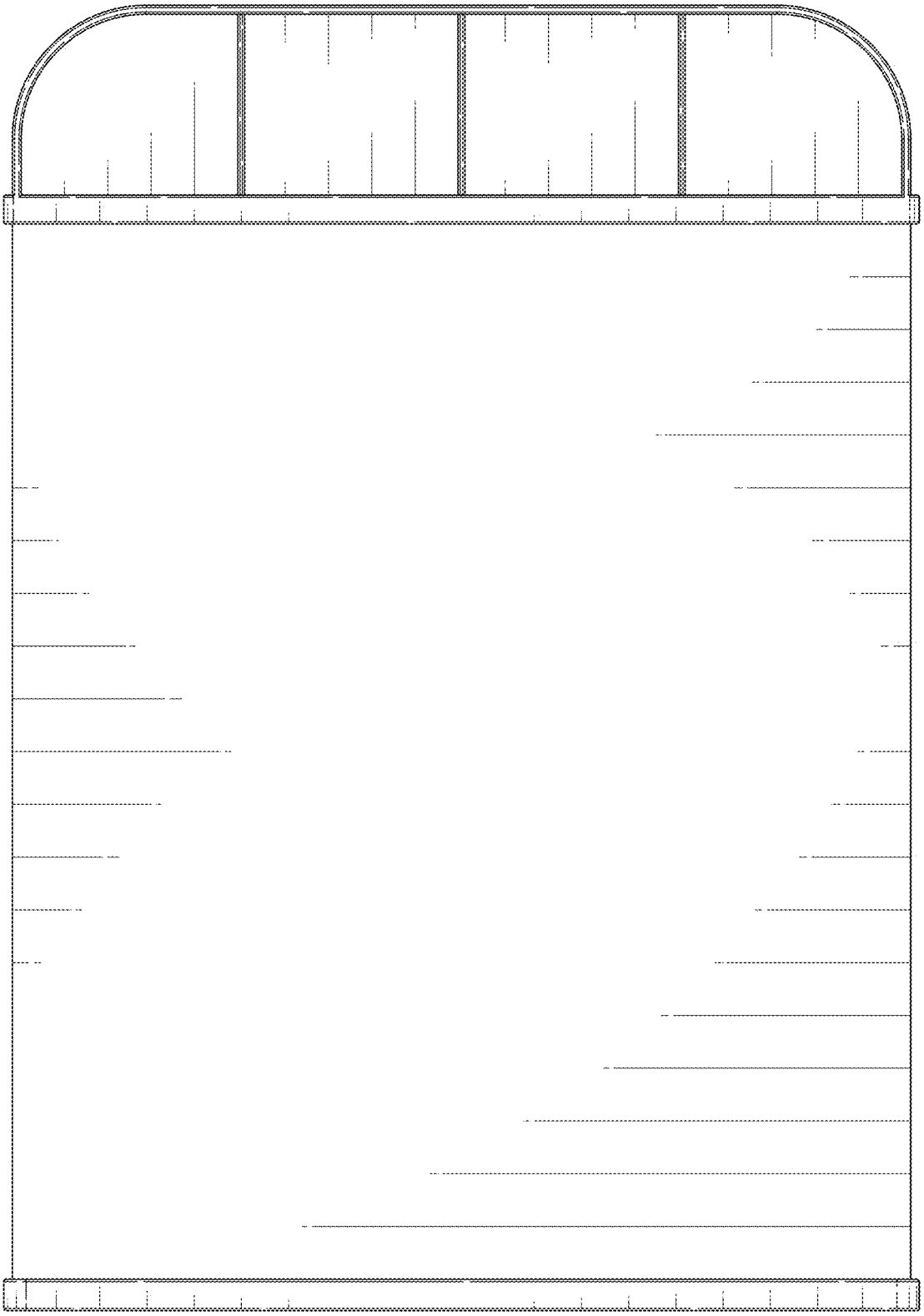
FIG. 49 is a back plan view of the toy system of FIG. 43.
Figure 50:
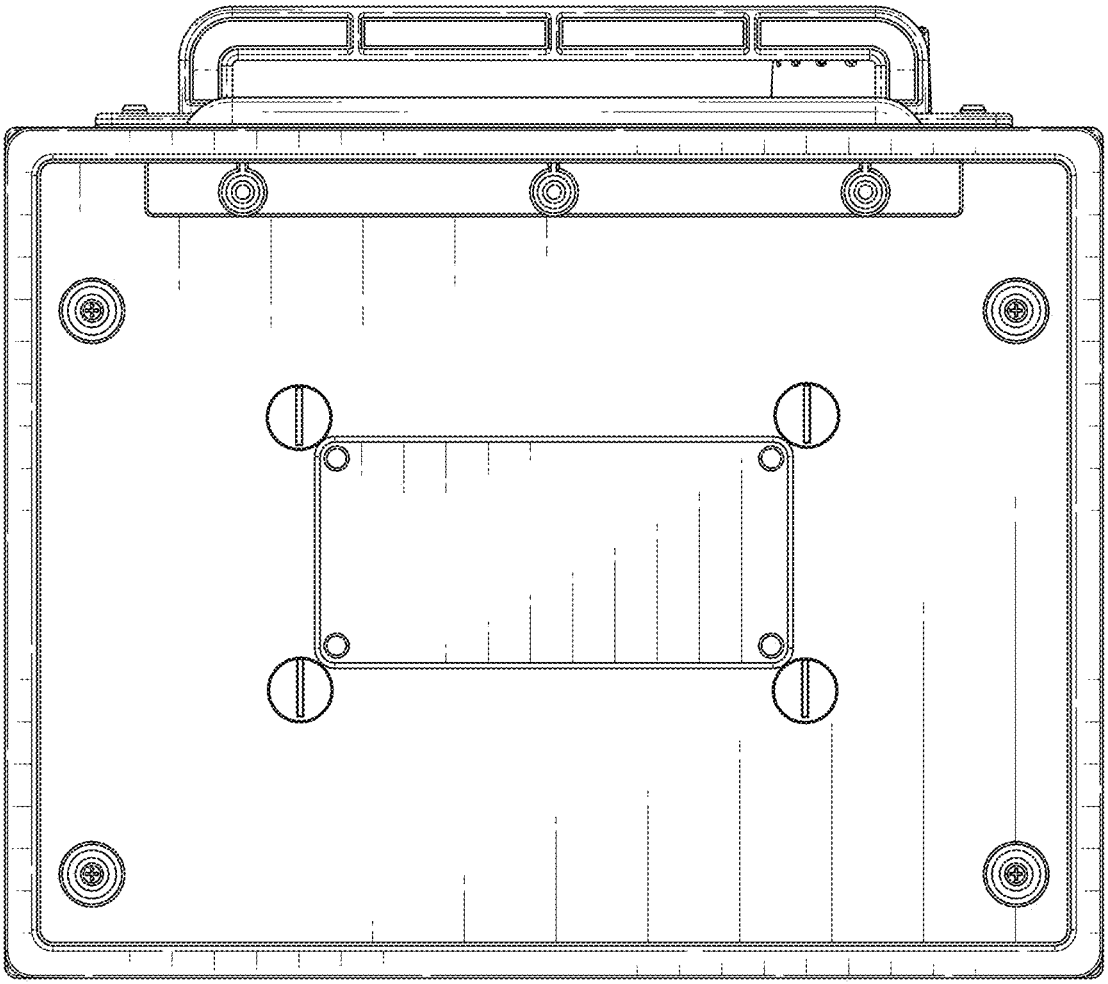
FIG. 50 is a bottom plan view of the toy system of FIG. 43.
Figure 51:
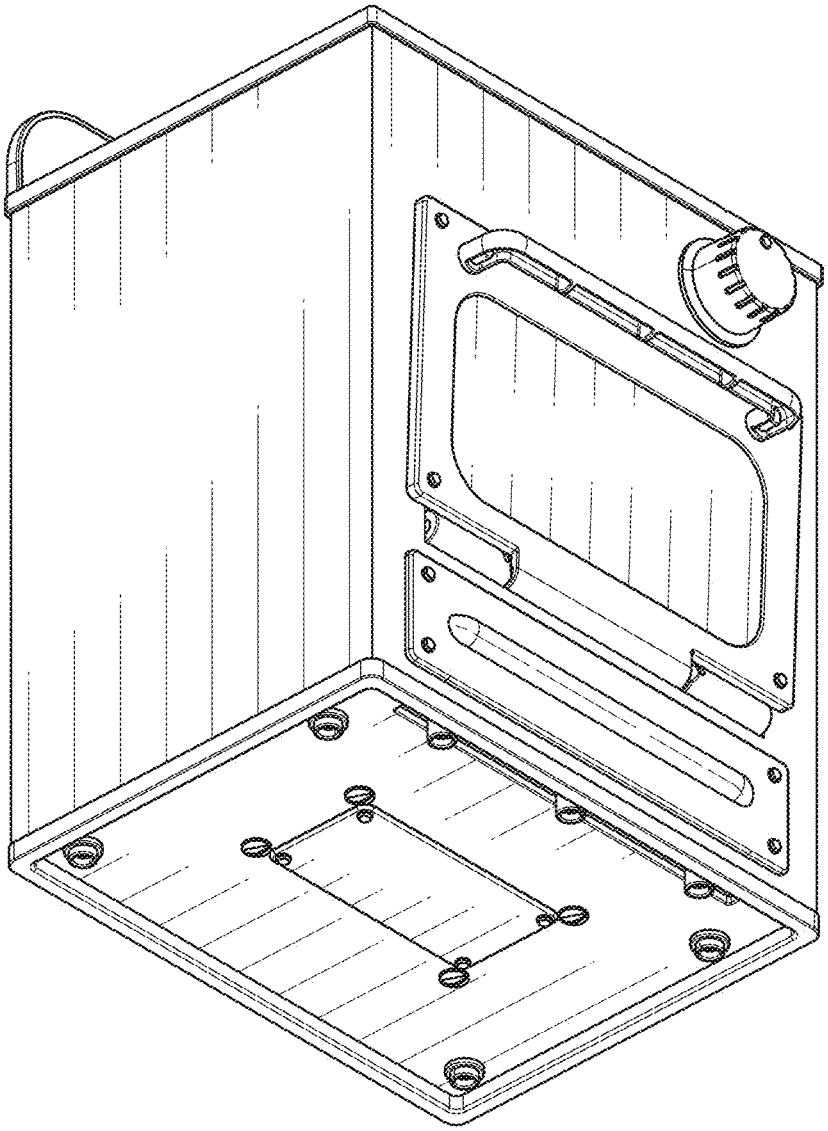
FIG. 51 is a front, left, bottom perspective view of the toy system of FIG. 43.

FIG. 43 is a front, right, top perspective view of an embodiment of the toy system. FIG. 44 is a front, left, top perspective view of the toy system of FIG. 43. FIG. 45 is a front plan view of the toy system of FIG. 43. FIG. 46 is a left-side plan view of the toy system of FIG. 43. FIG. 47 is a right-side plan view of the toy system of FIG. 43. FIG. 48 is a top plan view of the toy system of FIG. 43. FIG. 49 is a back plan view of the toy system of FIG. 43. FIG. 50 is a bottom plan view of the toy system of FIG. 43. FIG. 51 is a front, left, bottom perspective view of the toy system of FIG. 43.

Terminology

Although certain embodiments and examples are disclosed herein, inventive subject matter extends beyond the examples in the specifically disclosed embodiments to other alternative embodiments and/or uses, and to modifications and equivalents thereof. Thus, the scope of the claims appended hereto is not limited by any of the particular embodiments described above. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

For expository purposes, the term "horizontal" as used herein is defined as a plane parallel to the plane or surface of the floor or ground of the area in which the device being described is used or the method being described is performed, regardless of its orientation. The term "floor" can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

What is claimed is:

1. A toy oven system having an internal space for housing a toy, comprising:

a housing having an opening;

a door disposed relative to the opening so as to close and open the housing; and an upper shelf movably disposed in the internal space and capable of moving from an upper position to a lower position while the door is closed, the upper shelf being configured to support the toy, wherein when the upper shelf is in the upper position the upper shelf is located above the door and the toy is not visible through the opening, and wherein when the upper shelf is at the lower position in the internal space the toy is visible through the opening.

2. The toy oven system of claim 1, further comprising:

a lower shelf movably disposed in the internal space of the housing and capable of moving from the lower position to a bottom position; and wherein when the lower shelf is at the lower position a space above the lower shelf is visible through the opening, and wherein when the lower shelf is at the bottom position the space is not visible through the opening.

3. The toy oven system of claim 2, further comprising a knob coupled to the housing, wherein operating the knob causes the upper shelf to move from the upper position to the lower position and the lower shelf to move from the lower position to the bottom position.

4. The toy oven system of claim 1, further comprising a knob coupled to the housing, wherein operating the knob causes the upper shelf to move from the upper position to the lower position.

5. The toy oven system of claim 4, wherein operating the knob causes a latch to disengage from the upper shelf.

6. The toy oven system of claim 4, wherein opening the door prevents a user from rotating the knob.

7. The toy oven system of claim 4, wherein when the door is closed and while the user rotates the knob, the door cannot be opened.

8. The toy oven system of claim 4, wherein operating the knob initiates an oven baking process.

9. The toy oven system of claim 1, wherein the upper shelf is supported when in the upper position by a latch.

10. The toy oven system of claim 1, further comprising the toy, wherein the toy comprises a scent bag.

11. The toy oven system of claim 1, further comprising the toy, wherein the toy comprises a heater.

12. The toy oven system of claim 11, wherein the toy further comprises a module, the module being electrically coupled to the heater.

13. A toy oven system comprising:

a chamber having a wall forming an internal space configured to hold a toy;

a door disposed so as to close and open the chamber; and a shelf movably disposed in the internal space and capable of moving from an upper position to a lower position while the door is closed, wherein when the shelf is at the upper position the shelf and a portion of the internal space above the shelf is not visible through the door, and wherein when the shelf is at the lower position the portion of the internal space above the shelf is visible through the door.

14. The toy oven system of claim 13, further comprising the toy, wherein the toy comprises a scent bag.

15. The toy oven system of claim 13, further comprising the toy, wherein the toy comprises a heater.

16. The toy oven system of claim 15, wherein the toy further comprises a module, the module being electrically coupled to the heater.

17. A toy oven system having an internal space suitable for housing a toy, comprising:

a housing having an opening;

a door disposed relative to the opening so as to close and open the housing; and a shelf movably disposed in the internal space and capable of moving from an upper position to a lower position while the door is closed, the shelf being configured to support the toy, wherein when the shelf is in the upper position the shelf is located above the door and the toy is not visible through the opening, and wherein when the shelf is at the lower position in the internal space the toy is visible through the opening.

18. The toy oven system of claim 17, further comprising a knob coupled to the housing, wherein operating the knob causes the shelf to move from the upper position to the lower position.

19. The toy oven system of claim 17, wherein when the shelf is at the upper position a portion of the internal space above the shelf is not visible through the door, and wherein when the shelf is at the lower position the portion of the internal space above the shelf is visible through the door.

20. The toy oven system of claim 17, further comprising:

a lower shelf movably disposed in the internal space of the housing and capable of moving from the lower position to a bottom position; and wherein when the lower shelf is at the lower position a space above the lower shelf is visible through the opening, and wherein when the lower shelf is at the bottom position the space is not visible through the opening.

21. The toy oven system of claim 20, further comprising a knob coupled to the housing, wherein operating the knob causes the shelf to move from the upper position to the lower position and the lower shelf to move from the lower position to the bottom position.

22. A toy oven system having an internal space suitable for housing a toy, comprising:

a housing having an opening;

a door disposed relative to the opening so as to close and open the housing;

a shelf movably disposed in the internal space and capable of moving from an upper position to a lower position, the shelf being configured to support the toy; and a lower shelf movably disposed in the internal space of the housing and capable of moving from the lower position to a bottom position, wherein when the shelf is in the upper position the shelf is located above the door and the toy is not visible through the opening, and wherein when the shelf is at the lower position in the internal space the toy is visible through the opening, and wherein when the lower shelf is at the lower position a space above the lower shelf is visible through the opening, and wherein when the lower shelf is at the bottom position the space is not visible through the opening.

* * * * *